US009323200B2

(12) United States Patent
Takeuchi et al.

(10) Patent No.: US 9,323,200 B2
(45) Date of Patent: Apr. 26, 2016

(54) IMAGE FORMING APPARATUS THAT PERFORMS PARAMETER CORRECTION PROCESSING ACCORDING TO AN IMAGE DENSITY IN A PREDETERMINED REGION

(71) Applicants: Nobutaka Takeuchi, Kanagawa (JP); Akira Yoshida, Tokyo (JP)

(72) Inventors: Nobutaka Takeuchi, Kanagawa (JP); Akira Yoshida, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/487,741

(22) Filed: Sep. 16, 2014

(65) Prior Publication Data

US 2015/0220032 A1 Aug. 6, 2015

(30) Foreign Application Priority Data

Feb. 3, 2014 (JP) ..... 2014-018634

(51) Int. Cl.
*G03G 15/00* (2006.01)

(52) U.S. Cl.
CPC ..... *G03G 15/5058* (2013.01); *G03G 15/5041* (2013.01); *G03G 15/5054* (2013.01)

(58) Field of Classification Search
CPC ..... G03G 15/5041; G03G 15/553; G03G 15/5054; G03G 15/50; G03G 15/5058; G03G 15/5025
USPC ..... 399/49
See application file for complete search history.

(56) References Cited

U.S. PATENT DOCUMENTS

| | | | | |
|---|---|---|---|---|
| 4,962,394 | A * | 10/1990 | Sohmiya et al. | 399/60 |
| 7,509,060 | B2 * | 3/2009 | Yaguchi et al. | 399/15 |
| 7,515,844 | B2 | 4/2009 | Tanaka et al. | |
| 7,668,471 | B2 | 2/2010 | Takeuchi et al. | |
| 8,045,874 | B2 | 10/2011 | Yoshida et al. | |
| 8,099,006 | B2 | 1/2012 | Fujimori et al. | |
| 2007/0134012 | A1 * | 6/2007 | Suzuki et al. | 399/49 |
| 2010/0092191 | A1 * | 4/2010 | Sheflin et al. | 399/49 |
| 2012/0057889 | A1 * | 3/2012 | Yamaguchi | G03G 15/04054 399/51 |

FOREIGN PATENT DOCUMENTS

| | | |
|---|---|---|
| JP | H02-034877 | 2/1990 |
| JP | H07-199561 | 8/1995 |
| JP | H11-078123 | 3/1999 |
| JP | 2007-148260 | 6/2007 |
| JP | 2011-164544 | 8/2011 |

* cited by examiner

*Primary Examiner* — Clayton E LaBalle
*Assistant Examiner* — Trevor J Bervik
(74) *Attorney, Agent, or Firm* — Oblon, McClelland, Maier & Neustadt, L.L.P.

(57) ABSTRACT

An image forming apparatus includes an image information acquisition unit that acquires image information; a toner image formation unit that forms, in response to a control parameter, a toner image on a surface of an image carrier based on the image information; an image density detection unit that produces a detection result indicative of image density of the toner image; and a control unit that determines whether to use a predetermined region in the toner image formed on the surface of the image carrier based on the image information for a detection of the image density of the toner image, and when the predetermined region is determined to be used for the detection of the image density, corrects the control parameter used by the toner image formation unit based on the detection result so as to maintain the image density in the predetermined region within a predetermined range.

16 Claims, 24 Drawing Sheets

FIG.25

| DEGREE OF TONER ATTRACTION AMOUNT | HUGE | LARGE | ADEQUATE | SMALL | TINY |
|---|---|---|---|---|---|
| RANGE OF TONER ATTRACTION AMOUNT | TONER ATTRACTION AMOUNT ≥ UPPER THRESHOLD 2 | UPPER THRESHOLD 2 > TONER ATTRACTION AMOUNT ≥ UPPER THRESHOLD 1 | UPPER THRESHOLD 1 > TONER ATTRACTION AMOUNT ≥ LOWER THRESHOLD 1 | LOWER THRESHOLD 1 > TONER ATTRACTION AMOUNT ≥ LOWER THRESHOLD 2 | LOWER THRESHOLD 2 > TONER ATTRACTION AMOUNT |
| POLICY OF CORRECTION | INCREASE | INCREASE A LITTLE | NO CORRECTION | DECREASE A LITTLE | DECREASE |
| CORRECTION AMOUNT FOR Vtref | +0.1V | +0.05V | 0V | −0.05V | −0.1V |

FIG.27

| DEGREE OF TONER ATTRACTION AMOUNT | HUGE | LARGE | ADEQUATE | SMALL | TINY |
|---|---|---|---|---|---|
| RANGE OF TONER ATTRACTION AMOUNT | TONER ATTRACTION AMOUNT ≥ UPPER THRESHOLD 2 | UPPER THRESHOLD 2 > TONER ATTRACTION AMOUNT ≥ UPPER THRESHOLD 1 | UPPER THRESHOLD 1 > TONER ATTRACTION AMOUNT ≥ LOWER THRESHOLD 1 | LOWER THRESHOLD 1 > TONER ATTRACTION AMOUNT ≥ LOWER THRESHOLD 2 | LOWER THRESHOLD 2 > TONER ATTRACTION AMOUNT |
| POLICY OF CORRECTION | DECREASE ABSOLUTE VALUE | DECREASE ABSOLUTE VALUE A LITTLE | NO CORRECTION | INCREASE ABSOLUTE VALUE A LITTLE | INCREASE ABSOLUTE VALUE |
| CORRECTION AMOUNT FOR Vb | DECREASE ABSOLUTE VALUE BY 4 | DECREASE ABSOLUTE VALUE BY 2 | NO CORRECTION | INCREASE ABSOLUTE VALUE BY 2 | INCREASE ABSOLUTE VALUE BY 4 |

IMAGE FORMING APPARATUS THAT PERFORMS PARAMETER CORRECTION PROCESSING ACCORDING TO AN IMAGE DENSITY IN A PREDETERMINED REGION

BACKGROUND OF THE INVENTION

1. Field of the Invention

The disclosures herein generally relate to an image forming apparatus.

2. Description of the Related Art

Japanese Published Patent Application No. H7-199561 discloses an image forming apparatus which performs a parameter correction process for correcting a control parameter so as to obtain a desired image quality based on a result of detecting image density of a toner image formed on a surface of an image carrier. The image forming apparatus obtains the toner image by developing an electrostatic latent image on a surface of a photoreceptor which is the image carrier using developer including toner and carrier. When the toner in the developer in a developing device is used for the developing, toner density in the developer decreases. Therefore, a control unit in the image forming apparatus supplies toner into the developing device by driving a toner supply device, when a result of the toner density detected by a toner density detection sensor that detects the toner density in the developer in the developing device becomes less than a predetermined target value. According to the above operation, the toner density in the developer is restored. However, even if the toner density is maintained at a constant level, when an environment (temperature or humidity) or a charge quantity of toner fluctuates, the image density of the toner image obtained by the developing may be greater than or less than the target value.

The control unit periodically performs a target value correction process as follows. That is, a test toner image for detecting the image density is formed on the surface of the photoreceptor, and the image density of the test toner image is detected by a reflection type photo sensor. Then, based on a difference between a result of detection and target image density, the target value of the toner density in the developer is corrected, thereby the target image density is obtained. According to the above configuration, even if the environment or the charge quantity of toner fluctuates, an image can be formed having the target image density.

However, in the above image forming apparatus, since test toner images are formed periodically, an amount of consumption of toner increases and the cost of operation rises.

SUMMARY OF THE INVENTION

It is a general object of at least one embodiment of the present invention to provide an image forming apparatus that substantially obviates one or more problems caused by the limitations and disadvantages of the related art.

In one embodiment, an image forming apparatus includes an image information acquisition unit that acquires image information; a toner image formation unit that forms, in response to a control parameter, a toner image on a surface of an image carrier based on the image information acquired by the image information acquisition unit; an image density detection unit that produces a detection result indicative of image density of the toner image formed on the surface of the image carrier; and a control unit that performs determination processing for determining whether to use a predetermined region in the toner image formed on the surface of the image carrier based on the image information for a detection of the image density of the toner image in parameter correction processing, and when the predetermined region is determined to be used for the detection of the image density in the determination processing, performs the parameter correction processing for correcting the control parameter used by the toner image formation unit based on the detection result so as to maintain the image density in the predetermined region within a predetermined range.

According to the present invention, a control parameter is corrected based on a result of detection for the image density of a toner image, which is formed based on an instruction by a user and is suitable for use for detecting the image density. Accordingly, without forming a test toner image dedicated for detecting the image density, the control parameter is corrected appropriately, thereby an inadequacy in the image density due to a fluctuation of the environment and a charge quantity of toner can be suppressed with a lower cost than that of the related art.

BRIEF DESCRIPTION OF THE DRAWINGS

Other objects and further features of embodiments will be apparent from the following detailed description when read in conjunction with the accompanying drawings, in which:

FIG. 25 is a table illustrating the relation shown in FIG. 24;

FIG. 27 is a table illustrating the relation shown in FIG. 26;

DESCRIPTION OF THE PREFERRED EMBODIMENTS

In the following, embodiments of the present invention will be described with reference to the accompanying drawings.

In the following, an embodiment in which the present invention is applied to an electrophotographic printer as an image forming apparatus, which will be denoted simply as "printer" in the following, will be explained.

Figure 1:
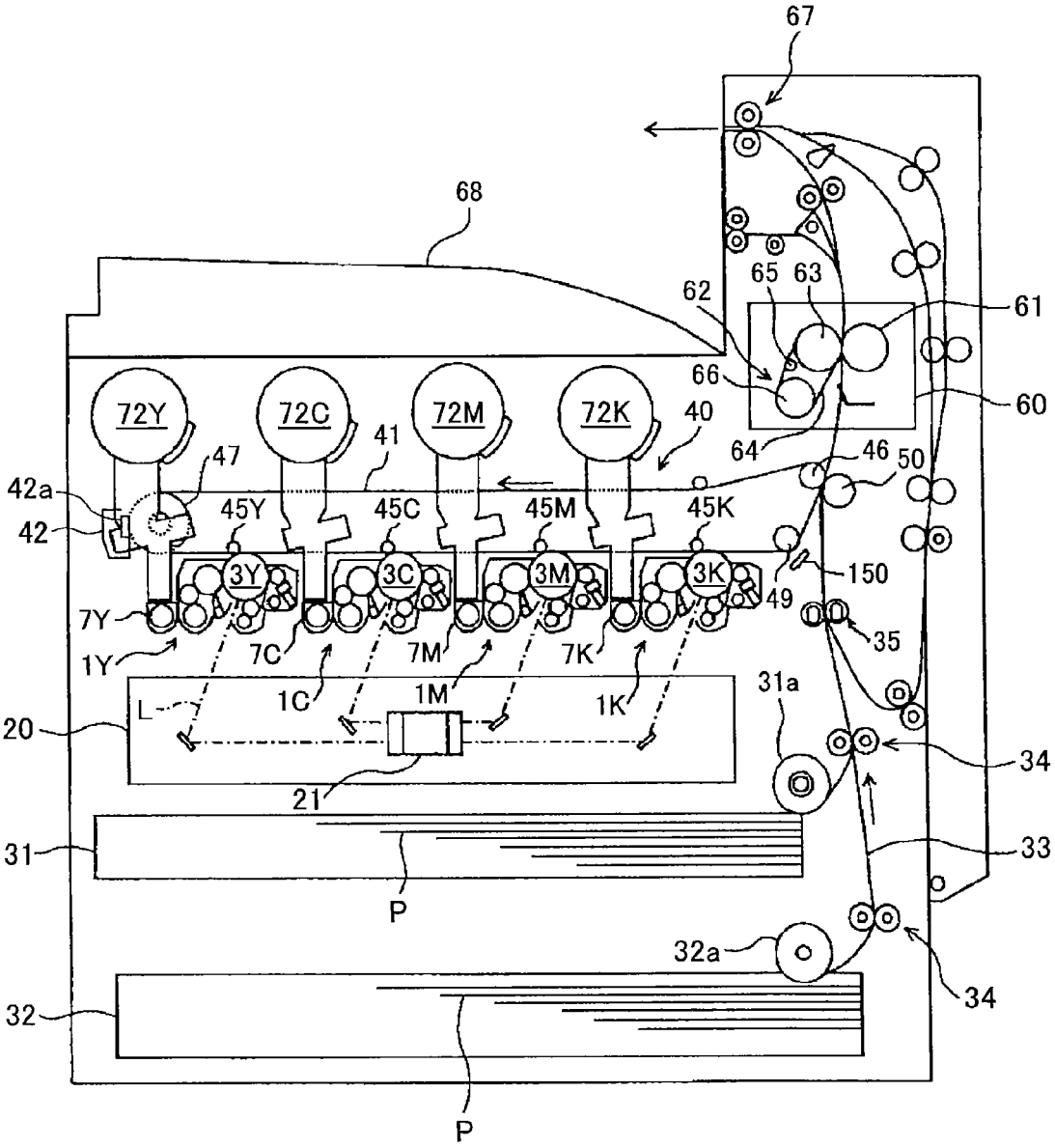
FIG. 1 is a schematic configuration diagram illustrating an example of a printer according to a present embodiment.

At first, a basic configuration of the printer according to the present embodiment will be explained. FIG. 1 is a schematic configuration diagram illustrating a printer according to a present embodiment. The printer is provided with four image formation units 1Y, 1C, 1M and 1K for yellow, cyan, magenta and black, respectively (denoted Y, C, M and K, in the following). These units use toners of different colors, Y, C, M and K as image formation material for forming an image. They have the same configuration other than the above feature.

Figure 2:
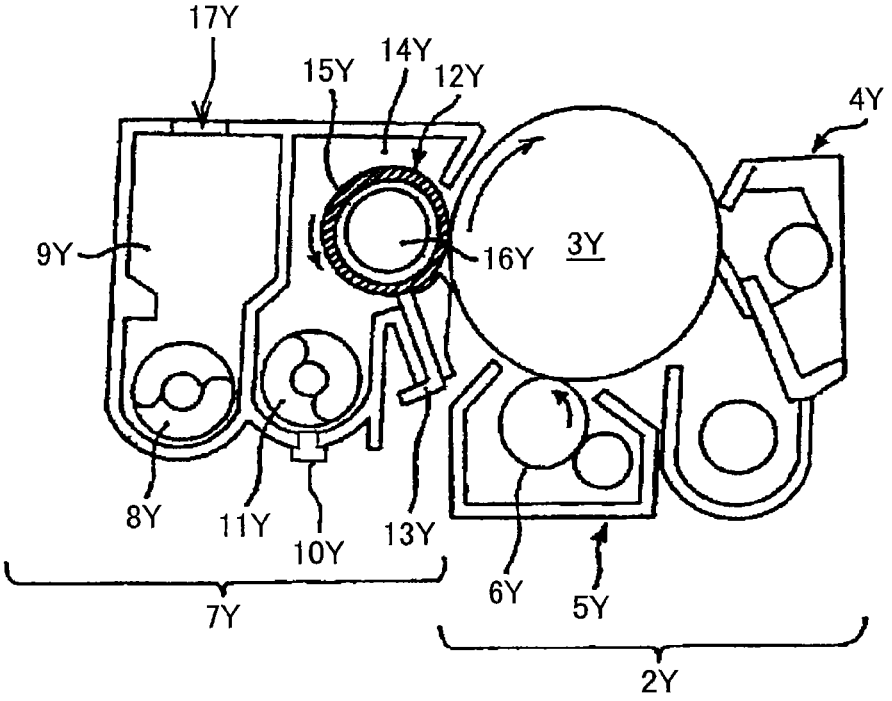
FIG. 2 is an enlarged schematic view illustrating an example of an image formation unit for forming a Y toner image in the printer according to the present embodiment.
Figure 3:
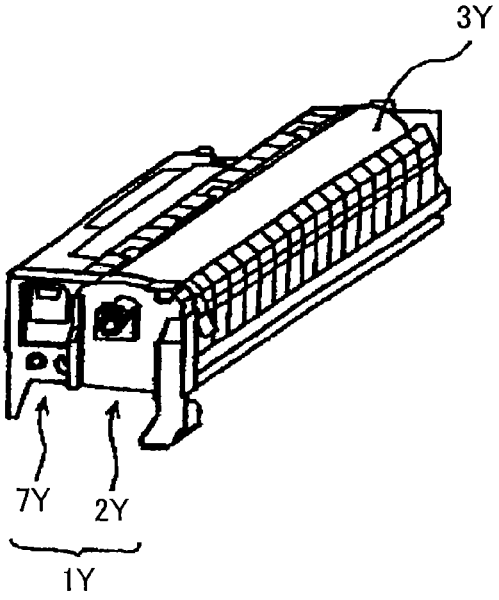
FIG. 3 is a perspective view illustrating an example of an outer appearance of the image formation unit according to the present embodiment.

FIG. 2 is a schematic view illustrating a configuration of the image formation unit 1Y for forming a Y toner image. FIG. 3 is a perspective view illustrating an outer appearance of the image formation unit 1Y. In these figures, the image formation unit 1Y has a photoreceptor unit 2Y and a developing unit 7Y. The photoreceptor unit 2Y and the developing unit 7Y are configured, as shown in FIG. 3, so as to be detachable from a printer main body integrally as the image formation unit 1Y. However, in a state detached from the printer main body, the developing unit 7Y can be detached from the photoreceptor unit, which is not shown.

The photoreceptor unit 2Y includes a drum-shaped photoreceptor 3Y as a latent image support body, a drum cleaning device 4Y, a neutralization device which is not shown, a charging device 5Y and the like. The charging device 5Y, as a charging means, uniformly charges by a charging roller 6Y a surface of the photoreceptor 3Y, shown in FIG. 2, which is rotationally driven in a clockwise direction by a driving means which is not shown. Specifically, in FIG. 2, a charging bias is applied from an electric power supply which is not shown to the charging roller 6Y which is rotationally driven in a counterclockwise direction. By making the charging roller 6 get close to or in contact with the photoreceptor 3Y, the photoreceptor 3Y is charged uniformly.

Meanwhile, a charging means that makes another charging member such as a charging brush, instead of the charging roller 6Y, get close to or in contact with may be used. Moreover, a charging means such as a scorotoron charger that uniformly charges the photoreceptor 3Y by a charger method may be used. The surface of the photoreceptor 3Y uniformly charged by the charging device 5Y is exposed and scanned by laser light emitted from an optical writing unit 20 as a latent image forming means which will be described later, and supports an electrostatic latent image for Y toner.

Figure 4:
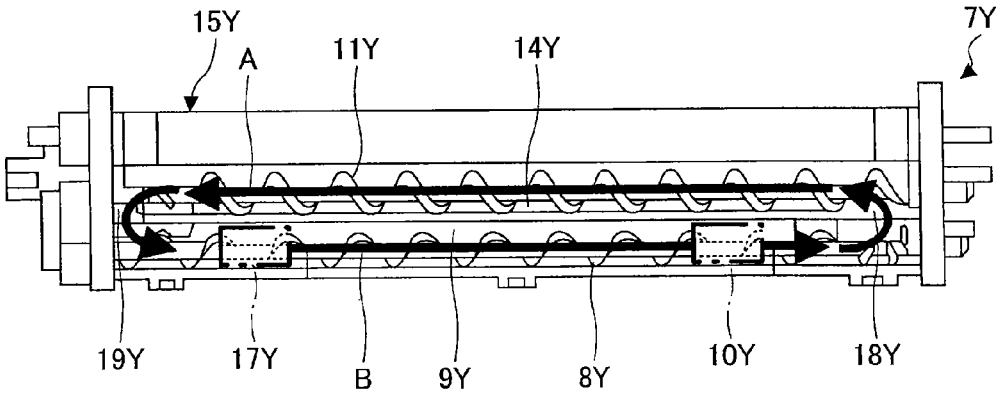
FIG. 4 is an exploded plan view illustrating an example of a developing unit of the image formation unit according to the present embodiment.

FIG. 4 is an exploded plan view illustrating an inside of the developing unit 7Y. The developing unit 7Y as a developing means, as shown in FIG. 2 or 4, includes a first agent container chamber 9Y, in which a first conveyor screw 8Y as a developing agent conveying means is arranged. Moreover, the developing unit 7Y also includes a toner density sensor 10Y having a magnetic permeability sensor as a toner density detection means, a developing roll 12Y as a developing agent supporting means and the like. Furthermore, the developing unit 7Y also includes a second agent container chamber 14Y in which a doctor blade 13Y as a developing agent regulating member and the like are arranged.

In the above two agent container chambers which form a circulation route, a Y developing agent (not shown) which is a two-component developing agent including magnetic carrier and Y toner of a negative charge type is included. The first conveyor screw 8Y, rotationally driven by a driving means (not shown), conveys the Y developing agent in the first agent container chamber toward the near side in FIG. 2 (in the direction of an arrow B in FIG. 4). For the Y developing agent during conveying, by the toner density sensor 10Y fixed above the first conveyor screw 8Y, the toner density of the Y developing agent passing through a predetermined detection point positioned on the downstream side in the developing agent circulating direction with respect to a point opposing a toner supply port 17Y in the first agent container chamber 9Y (in the following, denoted "supply position") is detected. Then, the Y developing agent conveyed to the end portion of the first agent container chamber 9Y by the first conveyor screw 8Y through a communication port 18Y enters inside the second agent container chamber 14Y.

The second conveyor screw 11Y in the second agent container chamber 14Y is rotationally driven by a driving means, which is not shown; thereby the Y developing agent is conveyed to the back side in FIG. 2 (in the direction of an arrow A in FIG. 4). In this way, above the second conveyor screw 11Y that conveys the Y developing agent a developing roll 12Y is arranged in a position parallel to the second conveyor screw 11Y. The developing roll 12Y includes a magnetic roller 16Y which is fixed inside a developing sleeve 15Y including a non-magnetic sleeve rotationally driven in the counter-clockwise direction in FIG. 2.

A part of the Y developing agent conveyed by the second conveyor screw 11Y is attracted to the surface of the developing sleeve 15Y by a magnetic force from the magnet roller 16Y. Then, after a layer thickness of the agent is regulated by the doctor blade 13Y arranged so as to maintain a predetermined gap with the surface of the developing sleeve 15Y, the agent is conveyed to a developing region opposing the photoreceptor 3Y, and the Y toner is attached to an electrostatic latent image for Y toner on the photoreceptor 3Y. According to this attachment, a Y toner image is formed on the photoreceptor 3Y. The Y developing agent which consumes Y toner for the developing is returned on the second conveyor screw 11Y by the rotation of the developing sleeve 15Y. Then, the Y developing agent conveyed to the end portion of the second agent container chamber 14Y by the second conveyor screw 11Y returns into the first agent container chamber 9Y through a communication port 19Y. In this way, Y developing agent is conveyed circularly in the developing unit 7Y.

A result of detection for the toner density of Y developing agent by the toner density sensor 10Y is sent as an electric signal to a control device which is not shown. This control device converts an output voltage from the toner density sensor 10Y into a toner density of the Y developing agent, and stores it in a not-shown RAM. Moreover, the control device converts output voltages from toner density sensors (10C, 10M and 10K) mounted on the developing units (7C, 7M and 7K) for C, M and K toners into toner densities of C, M and K developing agents, respectively. Meanwhile, the output voltage from the toner density sensor including the magnetic permeability sensor correlates with the toner density. The greater the toner density of the developing agent is, the lower the magnetic permeability of the developing agent is, and the output value from the toner density sensor decreases.

For the developing unit 7Y for Y toner, the result of detection for the toner density calculated based on the output voltage from the toner density sensor 10Y and a target value for control for the Y toner density stored in the RAM are compared. Then, a supply motor for Y toner in a toner supply device is driven for a length of time corresponding to an amount of Y toner which is supplied through a toner supply port based on the result of comparison. In this way, an appropriate amount of Y toner is supplied in the first agent container chamber 9Y to the Y developing agent in which they toner density has decreased due to the consumption of Y toner in the developing. Accordingly, the toner density of the Y developing agent in the second agent container chamber 14Y is maintained at around the target value for toner density. For developing agent in the developing unit 7C, 7M and 7K for the other colors, the toner density is maintained at around target value in the same way as above.

In FIG. 1, the Y toner image formed on the photoreceptor 3Y is intermediately transferred to an intermediate transfer belt 41 which is an intermediate transcript. A drum cleaning device 4Y of the photoreceptor unit 2Y removes toner remaining on the surface of the photoreceptor 3Y after the intermediate transfer process. Then, the surface of the photoreceptor 3Y on which the cleaning process is performed is neutralized by a neutralization device which is not shown. According to the neutralization, the surface of the photoreceptor 3Y is initialized and prepared for the next image formation. Also in the image formation units 1C, 1M and 1K for the other colors, a C toner image, an M toner image and a K toner image are formed on photoreceptors 3C, 3M and 3K, respectively, in the same way as above, and are intermediately transferred to the intermediate transfer belt 41.

Below the image formation units 1Y, 1C, 1M and 1K, the optical writing unit 20 is arranged. The optical writing unit 20 transmits laser light L emitted based on image information onto the photoreceptors 3Y, 3C, 3M and 3K of the image formation units 1Y, 1C, 1M and 1K, respectively. Then, on the photoreceptors 3Y, 3C, 3M and 3K, electrostatic latent images for Y, C, M and K toners are formed, respectively.

Meanwhile, the optical writing unit 20 transmits the laser light L emitted from the light source, while deflecting it with a polygon mirror 21 rotationally driven by a motor, onto the photoreceptor 3Y, 3C, 3M and 3K via plural optical lenses and mirrors. Instead of the above configuration, a configuration with an LED array may be used.

Below the optical writing unit 20 a first paper feeding cassette 31 and a second paper feeding cassette 32 are arranged so as to be overlapped with each other in the vertical direction. In these paper feeding cassettes, recording paper sheets P which are recording media are stored as in a bundle of stacked recording paper sheets. A first paper feeding roller 31*a* and a second paper feeding roller 32*a* are in contact with the recording paper sheets P placed at tops of the respective bundles. When the first paper feeding roller 31*a* is rotationally driven in the counter clockwise direction in FIG. 1 by a driving means which is not shown, the recording paper sheet P located at the top in the first paper feeding cassette 31 is ejected to a paper feeding path 33 that extends in the vertical direction at the right side of the cassettes in FIG. 1. Moreover, when the second paper feeding roller 32*a* is rotationally driven in the counter clockwise direction in FIG. 1 by a driving means which is not shown, the recording paper sheet P located at the top in the second paper feeding cassette 32 is ejected to the paper feeding path 33.

In the paper feeding path 33, plural pairs of conveying rollers 34 are arranged. The recording paper sheet P fed into the paper feeding path 33 is conveyed from the bottom to the top of FIG. 1 in the vertical direction, nipped between rollers of the pair of conveying rollers 34.

At an end of the paper feeding path 33, a pair of resist rollers 35 is arranged. As soon as the resist roller pair 35 nips the recording paper sheet P fed by the pair of conveying rollers 34, the rotation of the resist roller pair 35 is stopped. Then, the pair of resist rollers 35 sends the recording paper sheet P to the secondary transferring nip, which will be described later, at an appropriate timing.

Above the processing image formation units 1Y, 1C, 1M and 1K, a transferring unit 40 which moves the intermediate transfer belt 41 endlessly in the counter-clockwise direction while stretching the intermediate transfer belt 41 is arranged. The transferring unit 40 includes, in addition to the intermediate transfer belt 41, a belt cleaning unit 42, a first bracket (not shown), a second bracket (not shown) and the like. Moreover, the transferring unit 40 also includes four primary transfer rollers 45Y, 45C, 45M and 45K, a secondary transfer backup roller 46, a driving roller 47, an auxiliary roller (not shown), a nip entering roller 49, and the like. The intermediate transfer 41 is stretched over these rollers, and moved endlessly in the counter-clockwise direction in FIG. 1 by the rotational driving of the driving roller 47.

The four primary transfer rollers 45Y, 45C, 45M and 45K nip the intermediate transfer belt 41, moving endlessly, with the photoreceptors 3Y, 3C, 3M and 3K, respectively, and form primary transferring nips. Then, to the internal surface of the intermediate transfer belt 41, a transfer bias having a polarity (a plus in the present embodiment) opposite to that of the toner is applied. While the intermediate transfer belt 41 sequentially goes through the primary transferring nips for Y, C, M and K, the intermediate transfer belt 41 moves endlessly, and toner images of the colors, formed on the respective photoreceptors 3Y, 3C, 3M and 3K are primarily transferred to the external surface of the intermediate transfer belt 41 so that the images overlap each other. In this way, an overlapping toner image (in the following, denoted "four-color toner image") is formed on the intermediate transfer belt 41.

The secondary transfer backup roller 46 nips the intermediate transfer belt 41 with a secondary transfer roller 50 which is arranged outside a loop of the intermediate transfer belt 41, and forms a secondary transferring nip. The pair of resist rollers 35, as described above, sends the recording paper sheet P nipped between the rollers to the secondary transferring nip at a timing synchronized with the four-color toner image on the intermediate transfer belt 41. The four-color toner image on the intermediate transfer belt 41 is secondarily transferred onto the recording paper sheet P in the secondary transferring nip under an influence from the secondary transfer electric field formed between the secondary transferring roller 50 on which a secondary transfer bias is applied and the secondary transfer backup roller 46 and from nip pressure. Along with a white color of the recording paper sheet P, a full color toner image is obtained.

On the intermediate transfer belt 41 after going through the secondary transferring nip, residual toner, not transferred onto the recording paper sheet P remains attached. This is cleaned by the belt cleaning unit 42. Meanwhile, the belt cleaning unit 42 holds a cleaning blade 42*a* in contact with a front surface of the intermediate transfer belt 41, and removes the residual toner by wiping the residual toner on the belt 41 with the blade 42*a*.

Meanwhile, the first bracket of the transferring unit 40 fluctuates in a predetermined rotation angle around a rotation axis of the auxiliary roller with an operation of ON and OFF for driving a solenoid which is not shown.

The printer according to the present embodiment, in the case of forming a monochromatic image, slightly rotates the first bracket in the counter clockwise direction in FIG. 1 by driving of the solenoid. By the rotation, as above, the primary transfer rollers 45Y, 45C and 45M for Y, C and M are caused to rotate in the counter-clockwise direction in FIG. 1, around the rotation axis of the auxiliary roller 47 to move the intermediate transfer belt 41 from the photoreceptors 3Y, 3C and 3M for Y, C and M. Then, out of the four image formation units 1Y, 1C, 1M and 1K, only the image formation unit for K is driven and a monochromatic image is formed. In this way, toner exhaustion of the image formation units for Y, C and M by driving wastefully the image formation units for Y, C and M in the case of forming a monochromatic image can be prevented.

Above the secondary transferring nip in FIG. 1, a fixing unit 60 as a fixing means is arranged. The fixing unit 60 includes a pressing and heating roller 61 having a heat source such as a halogen lamp and a fixing belt unit 62. The fixing belt unit 62 includes a fixing belt 64, a heating roller 63 having a heat source such as a halogen lamp, a tension roller 65, a driving roller 66 and a temperature sensor which is not shown. Then, the fixing belt unit 62 stretches the endless fixing belt 64 by the heating roller 63, the tension roller 65 and the driving roller 66, and moves the belt endlessly in the counter-clockwise direction in FIG. 1. While moving endlessly, the rear side of the fixing belt 64 is heated by the heating roller 63.

At a point where the fixing belt 64 is stretched over the heating roller 63, the pressing and heating roller 61 which is rotationally driven in the clockwise direction in FIG. 1 is in contact with the front surface of the fixing belt 64. In this way, a fixing nip is formed where the pressing and heating roller 61 and the fixing belt 64 are in contact with each other.

Outside the loop of the fixing belt 64, a temperature sensor which is not shown is arranged facing the front surface of the fixing belt 64 with a predetermined gap with it, and detects a temperature at the surface of the fixing belt 64 right before entering the fixing nip. A result of the detection is sent to a fixing power circuit which is not shown. The fixing power circuit controls ON and OFF for a supply of power to the heat source included in the heating roller 63 or the heat source included in the pressing and heating roller 61, based on the detection result of the temperature sensor. In this way, the temperature of the fixing belt 64 at the surface is maintained at about 140° C.

The recording paper sheet P, which goes through the secondary transferring nip, is separated from the intermediate transfer belt 41 and sent into the fixing unit 60. Then, while the recording paper sheet P is conveyed from the bottom to the top in FIG. 1, nipped by the fixing nip in the fixing unit 60, the recording paper sheet P is heated and pressed; thereby the full-colored toner image is fixed onto the recording paper sheet P.

The recording paper sheet P, thus having the fixing process applied, is ejected to the outside after passing between rollers of a pair of paper ejecting rollers 67. On the top surface of the chassis of the printer, a stacking unit 68 is formed, and the recording paper sheets P ejected by the pair of paper ejecting rollers 67 are stacked sequentially on the stacking unit 68.

Above the transferring unit 40, four containers for toner, toner bottles 72Y, 72C, 72M and 72K, for storing respectively Y toner, C toner, M toner and K toner, are provided. The toners of respective colors in the toner bottles 72Y, 72C, 72M and 72K are supplied appropriately to the developing units 7Y, 7C, 7M and 7K of the image formation units 1Y, 1C, 1M and 1K by a toner supply device 70 (See FIG. 7). The toner bottles 72Y, 72C, 72M and 72K are detachable from the printer main body independently of the image formation units 1Y, 1C, 1M and 1K.

In FIG. 4, the toner density sensor 10Y, in the first agent container chamber 9Y, detects the toner density of the developing agent right before entering the second agent container chamber 14Y. Moreover, the toner supply port 17Y is arranged at a position to supply toner to the developing agent right after entering the first agent container chamber 9*y* from the second agent container chamber 14Y. That is, in the first agent container chamber 9Y, the toner density sensor 10Y detects the toner density of the developing agent at a position downstream of the toner supply port 17Y.

Figure 5:
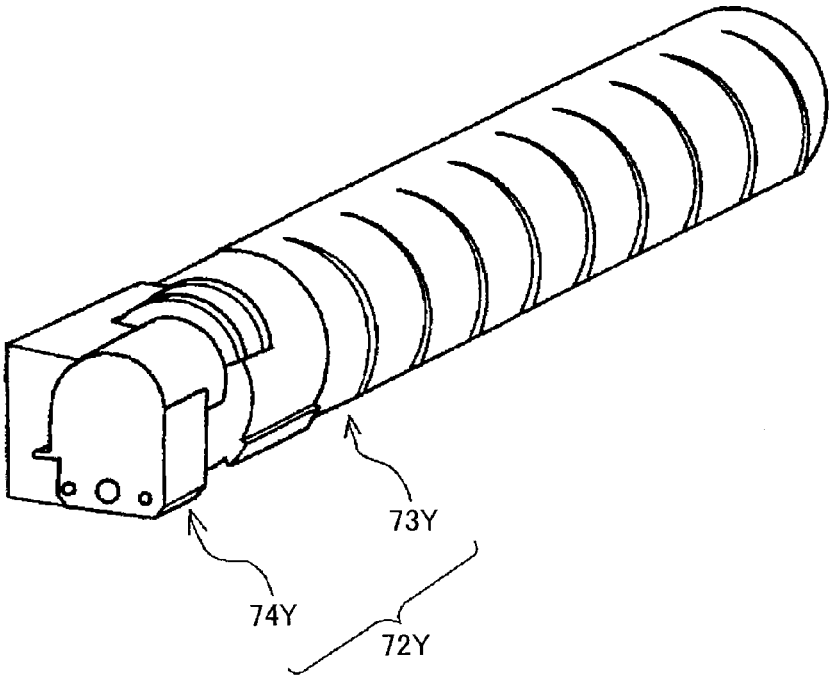
FIG. 5 is a perspective view illustrating an example of a toner bottle for Y toner in the printer according to the present embodiment.

FIG. 5 is a perspective view of the Y toner bottle 72Y. In FIG. 5, the Y toner bottle 72Y includes a bottle-shaped bottle unit 73Y as a powder containing unit that contains the Y toner in a powder form which is not shown and a cylinder-shaped holder unit 74Y as a powder ejecting unit.

Figure 6:
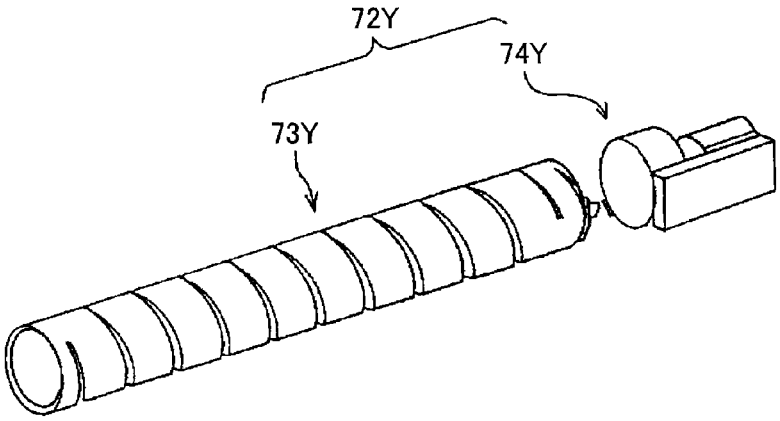
FIG. 6 is a perspective view illustrating an example of the toner bottle in a state where a bottle part is separated from a holder part according to the present embodiment.

The holder unit 74Y, as shown in FIG. 6, is engaged with the top of the bottle-shaped bottle unit 73Y, holding the bottle unit 73Y rotatably. On the inner circumference of the bottle unit 73Y, a screw-like spiral shaped protrusion, protruding toward inside the container from outside is formed so as to extend in a direction of an axis line of the bottle.

Figure 7:
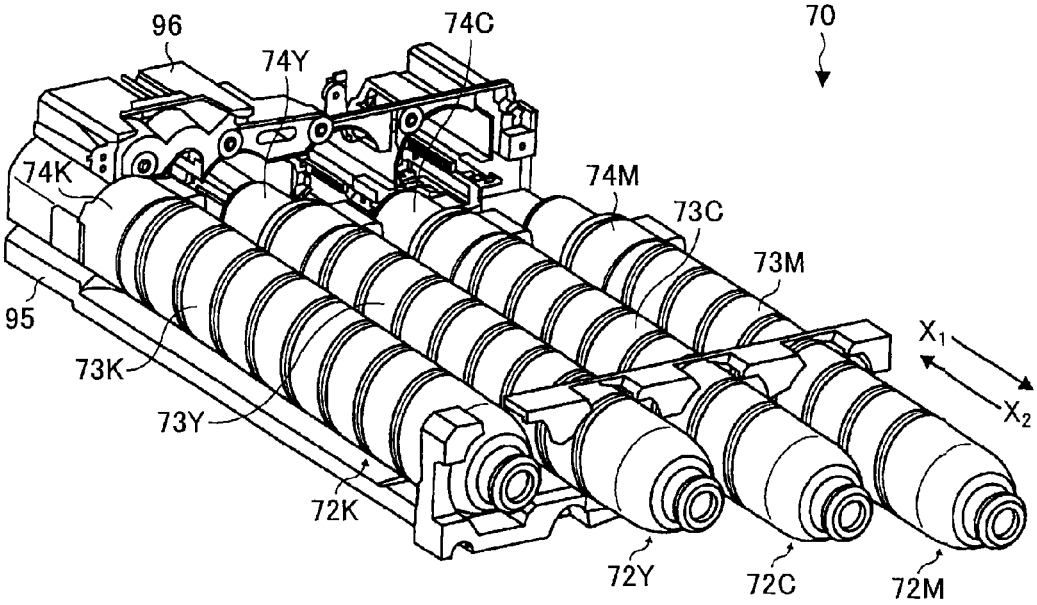
FIG. 7 is a perspective view illustrating an example of a toner supply device in the printer according to the present embodiment.

FIG. 7 is a perspective view of the toner supply device 70 in the printer according to the present embodiment. In FIG. 7, the toner supply device 70, as a toner supplying means, includes a bottle placing platform 95 for placing the four toner bottles 72K, 72Y, 72C and 72M, a bottle driving unit 96 that rotationally drives each bottle unit individually, or the like. Each of the toner bottles 72K, 72Y, 72C and 72M placed on the bottle placing platform 95 has its holder unit engaged with the bottle driving unit 96.

As shown by an arrow X1 in FIG. 7, when the toner bottle 72M engaged with the bottle driving unit 96 is slid in a direction away from the bottle driving unit on the bottle placing platform 95, the holder unit 74M of the toner bottle 72M is removed from the bottle driving unit 96. In this way, the toner bottle 72M can be removed from the toner supply device 70.

On the other hand, in the toner supply device 70 in a state where the toner bottle 72M is not attached, as shown by an arrow X2 in FIG. 7, the toner bottle 72M is slid in a direction approaching the bottle driving unit 96 on the bottle placing platform 95. Then, the holder unit 74M of the toner bottle 72M is engaged with the bottle driving unit 96. In this way, the toner bottle 72M can be attached to the toner supply device 70. The same operation can be performed to remove/attach the toner bottles 72K, 72Y and 72C of the other colors from/to the toner supply device 70.

On outer circumferences of head portions of the bottle units 73K, 73Y, 73C and 73M of the toner bottles 72K, 72Y, 72C and 72M, respectively, gear units, which are not shown, are formed. The gear units are covered by the holder units 74K, 74Y, 74C and 74M. However, in a part of the circumference of each of the holder units 74K, 74Y, 74C and 74M, a cutout, which is not shown, is formed to expose the gear unit partially, and a part of the gear unit is exposed from the cutout.

When the holder unit 74K, 74Y, 74C or 74M of the toner bottle 72K, 72Y, 72C or 72M is engaged with the bottle driving unit 96, a bottle driving gear, which is not shown, for K, Y, C or M provided in the bottle driving unit 96 is engaged with the gear unit of the bottle unit 73K, 73Y, 73C or 73M via the cutout. Then, the bottle driving unit for K, Y, C or M of the bottle driving unit 96 is rotationally driven by a driving system, which is not shown, thereby the bottle unit 73K, 73Y, 73C or 73M is rotationally driven on the holder unit 74K, 74Y, 74C or 74M.

In FIG. 5, when the bottle unit 73Y is rotated in this way on the holder unit 74Y, the Y toner in the bottle unit 73Y moves from the bottom to the top of the bottle unit along the above-described screw-shaped spiral protrusion. Then, the Y toner enters the cylinder-shaped holder unit 74Y through a bottle opening, which is not shown, formed at an end of the bottle unit 73Y as the powder containing unit that contains the Y toner in a powder form.

Figure 8:
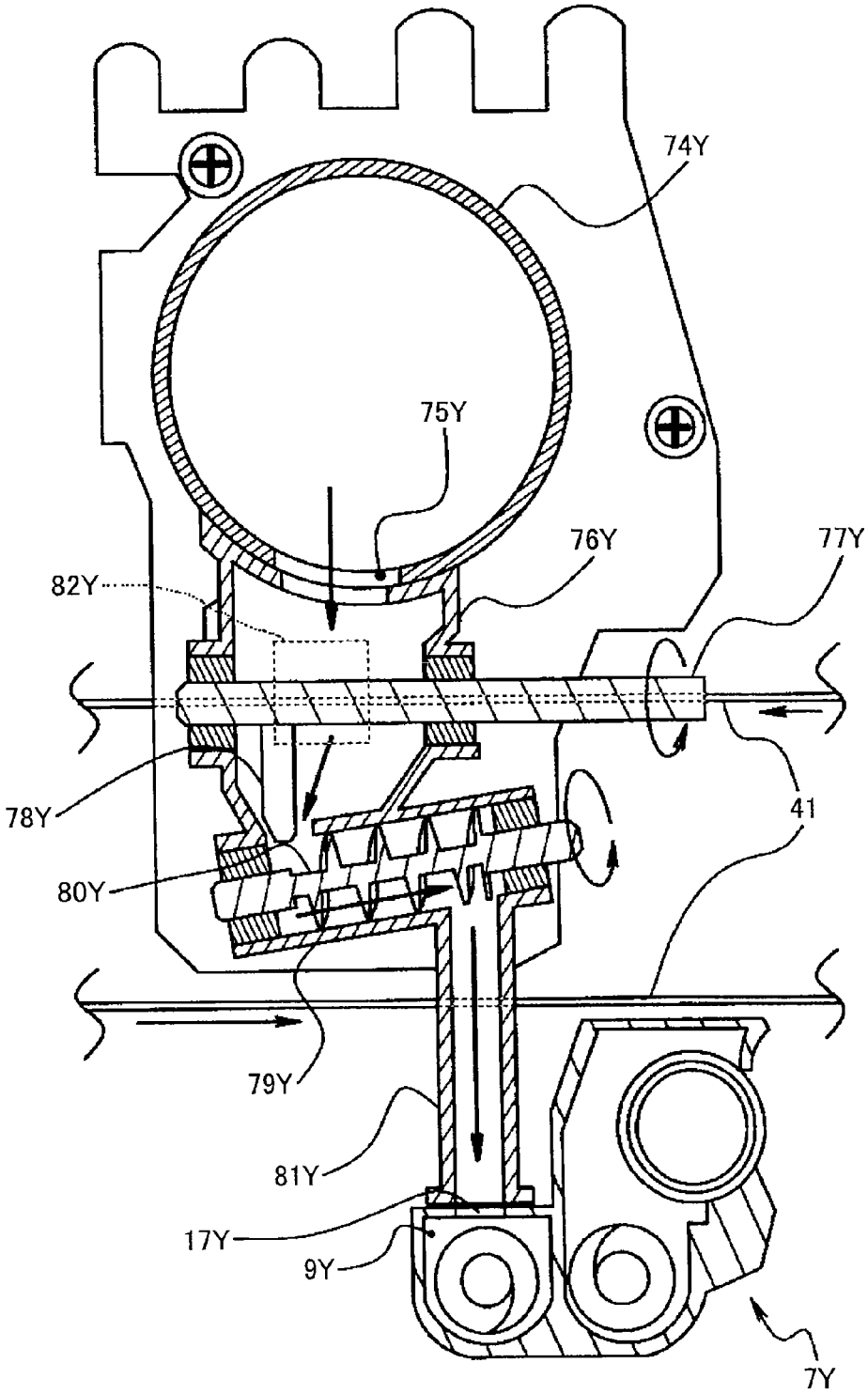
FIG. 8 is a schematic configuration diagram illustrating an example of the toner bottle in a state of being attached to the toner supply device and a configuration around it according to the present embodiment.

FIG. 8 is a schematic configuration diagram illustrating the toner bottle attached to the toner supply device and configuration around it. FIG. 8 illustrates a cross-sectional diagram of the toner bottle that is cut across the holder unit 74Y. As described above, a bottle unit, which is not shown, provided behind the holder unit 74Y in FIG. 8 is rotationally driven, and Y toner in the bottle unit enters into the holder unit 74Y.

The holder unit 74Y of the toner bottle is engaged with a hopper unit 76Y of the toner supply device. The hopper unit 76Y has a flat shape along a direction perpendicular to the surface of the drawing, and is located in front of the intermediate transfer belt 41 in FIG. 8. A toner ejection port 75Y formed at the bottom of the holder unit 74Y and a toner reception port formed in the hopper unit 76Y of the toner supply device are in communication with each other.

The Y toner sent from the bottle unit of the toner bottle to the folder unit 74Y is dropped into the hopper 76Y by its own weight. In the hopper unit 76Y, a flexible pressing film 78Y fixed on a rotatable rotating shaft member 77Y rotates with the rotating shaft member 76Y. On an inner wall of the hopper unit 76Y, a toner detection sensor 82Y including a piezoelectric element that detects a presence of Y toner in the hopper unit 76Y is fixed.

The pressing film 78Y made of polyethylene terephthalate (PET) presses the Y toner against a detection surface of the toner detection sensor 82Y along with its rotation. In this way, the toner detection sensor 82Y can detect the Y toner in the hopper 76Y reliably. The rotational driving of the bottle unit of the toner bottle is controlled so that the toner detection sensor 82Y detects the Y toner reliably. Therefore, as long as sufficient toner is in the bottle unit, a sufficient amount of the Y toner drops into the hopper 76Y via the holder unit 74Y from the bottle unit, and inside the hopper unit 76Y is filled with a sufficient amount of the Y toner. Assume that it is changed from the above state to a state where the Y toner is hardly detected by the toner detection sensor 82Y though the holder unit is frequently rotationally driven. Then, a control device, which is not shown, considers that an amount of the Y toner remaining in the bottle unit is small, and provides a user with an alarm of "toner near-end".

To a lower part of the hopper unit 76Y, a lateral conveying pipe 79Y is connected. The Y toner in the hopper unit 76Y slides along a taper by its own weight and drops into the lateral conveying pipe 79Y. In the lateral conveying pipe 79Y, a toner supply screw 80Y is arranged. Along with a rotational driving of the toner supply screw 80Y, the Y toner is laterally conveyed along the longitudinal direction of the lateral conveying pipe 79Y.

To a first end part in the longitudinal direction of the lateral conveying pipe 79Y, a drop guide pipe 81Y is connected extending in the vertical direction. A bottom end of the drop guide pipe 81Y is connected to the toner supply port 17Y of the first agent container chamber 9Y of the developing unit 7Y. When the toner supply screw 80Y in the lateral conveying pipe 79Y rotates, the Y toner conveyed to the first end part in the longitudinal direction of the lateral conveying pipe 79Y drops into the first agent container chamber 9Y of the developing unit 7Y through the drop guide pipe 81Y and the toner supply port 17Y. In this way, the Y toner is supplied into the first agent container chamber 9Y. Moreover, the toners of the other colors (C, M and K) are supplied in the same manner.

Figure 9:
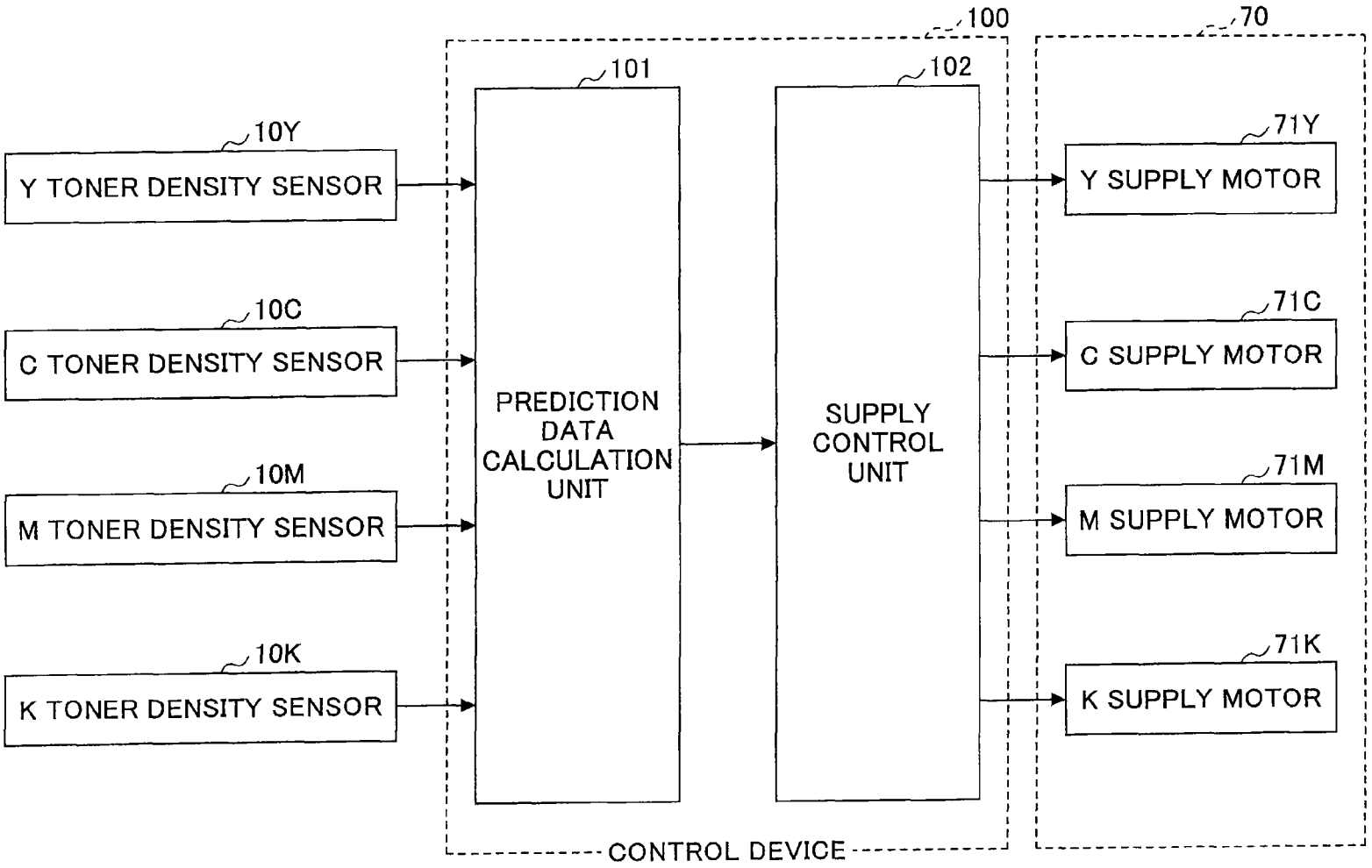
FIG. 9 is a block diagram illustrating an example of a part of an electric circuit in the printer according to the present embodiment.

FIG. 9 is a block diagram illustrating a part of electric circuit in the printer according to the present embodiment. An adjustment of supply amounts of Y, C, M and K toners is performed by controlling driving of supply motors 71Y, 71C, 71M and 71K for Y, C, M and K toners by a control device 100 which functions as a supply control means. Meanwhile, for a toner supply member, as long as the supply amount of toner into the developing unit from a toner supply port (for example, 17Y) is adjusted by a driving force of a supply motor (for example, 71Y), a publicly known member can be used.

The control device 100 includes a CPU (Central Processing Unit) as a computing means, a RAM (Random Access Memory) as a data storing means, a ROM (Read Only Memory) or the like. The control device 100 can perform various calculation processing, or can execute control programs, and stores control target values for density of Y, C, M and K toners, respectively, in the RAM.

A supply control unit 102 in the control device 100 controls driving of the supply motors (71Y, 71C, 71M and 71K) for the respective colors in the toner supply device 70, based on prediction data calculated by a prediction data calculation unit 101 that functions as a prediction data calculation means. The prediction data calculation unit 101 calculates prediction data for temporal change in toner density of a developing agent, based on a detection result for toner density by the toner density sensor or on control target values for toner density and a calculation program and a calculation table stored in the ROM.

Figure 10:
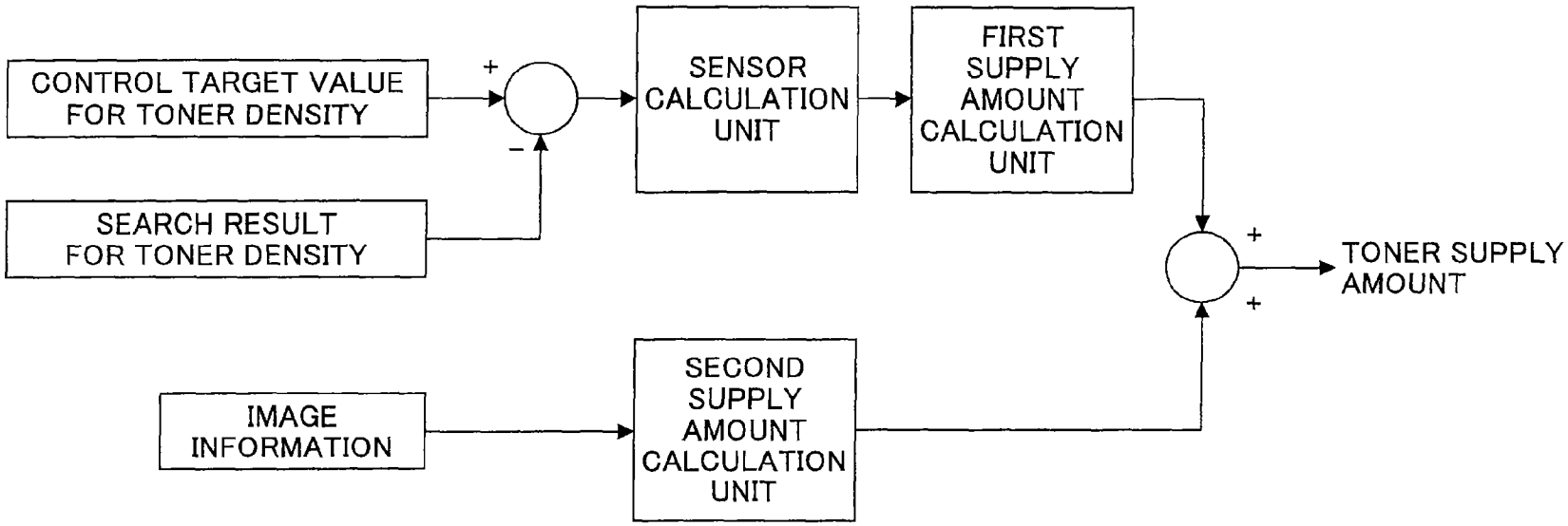
FIG. 10 is a block diagram for explaining in the electric circuit an example of a process of determining a toner supply amount conducted by a control device in the printer according to the present embodiment.

FIG. 10 is a block diagram for explaining in the electric circuit a process of determining a toner supply amount conducted by the control device 100. Actually, the control device 100 determines the toner supply amount by calculation processing. But, in order to facilitate understanding of it a process of the calculation processing will be explained in terms of a circuit. The control circuit 100 compares the control target value for toner density with the detection result of toner density, and controls the driving of the supply motor (for example, 71Y) so as to supply toner of the amount according to the comparison result from the toner supply port (for example, 17Y) into the developing unit. According to the above control, an appropriate amount of toner is supplied in the first agent container chamber (for example, 9Y) of the developing unit to developing agent in which toner density decreases due to consumption of toner in developing. In this way, the toner density of the developing agent in the second agent container chamber (for example, 14Y) is maintained at around the control target value.

In the control device 100, at first, the detection result of toner density and the control target value of toner density are compared, and its result is input into a sensor calculation unit. Then, by a first supply amount calculation unit, based on the comparison result or the like, a toner supply amount for eliminating a difference between the detection result of toner density and the control target value of toner density is calculated. During an operation of a continuous printing, since the developing is performed continuously, only by supplying toner of an amount corresponding to the toner supply amount, the toner density cannot be adjusted to the control target value. Then, a toner supply amount so as to cancel the toner consumption amount in the developing is calculated in the second supply amount calculation unit based on information related to images to be output, such as information on the images or information on a paper. A final toner supply amount is obtained by adding the toner supply amount calculated in the first supply amount calculation unit and the toner supply amount calculated in the second supply amount calculation unit.

Figure 11:
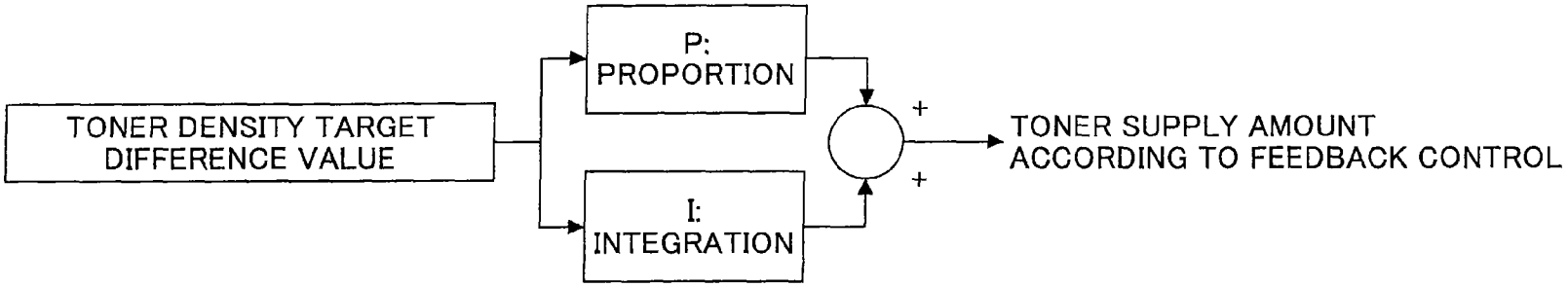
FIG. 11 is a block diagram for explaining in the electric circuit an example of a calculation processing executed in a first supply amount calculation unit in FIG. 10.

FIG. 11 is a block diagram for explaining an example of calculation processing executed in the first supply amount calculation unit in terms of circuit. FIG. 11 shows an example of calculating a toner supply amount by PI control. To the first supply amount calculation unit, a target difference value of toner density which is a difference between the control target value of toner density and the detection result of toner density is input. The greater the target difference value of toner density is, the greater the difference between the toner density and the control target value is. The target difference value of toner density is input to a proportion processing unit (P) and an integral processing unit (I), respectively. Then, in the proportion processing unit (P), the target difference value of toner density is multiplied by a predetermined gain. In this way, a toner supply amount of the value proportional to a difference value of toner density is obtained. On the other hand, in the integral processing unit (I), an integral value in which the target difference values of toner density are accumulated is obtained. In the case where at certain timing the target difference value of toner density is significantly great, the integral value becomes a great value, and the toner supply amount is calculated to be a great value. In this way, a prompt recovery for the toner density is promoted. When the toner supply amount is appropriate, the integral value rapidly becomes smaller. In the first supply amount calculation unit, a sum of the toner supply amount calculated by the proportion processing unit and the toner supply amount calculated by the integral processing unit is calculated as a toner supply amount by a FB (feedback) control. Meanwhile, in addition to the PI control, as long as a toner supply amount corresponding to a difference for an input and a toner supply amount corresponding to an accumulation of the difference are reflected, a calculation method by the other control may be employed.

Figure 12:
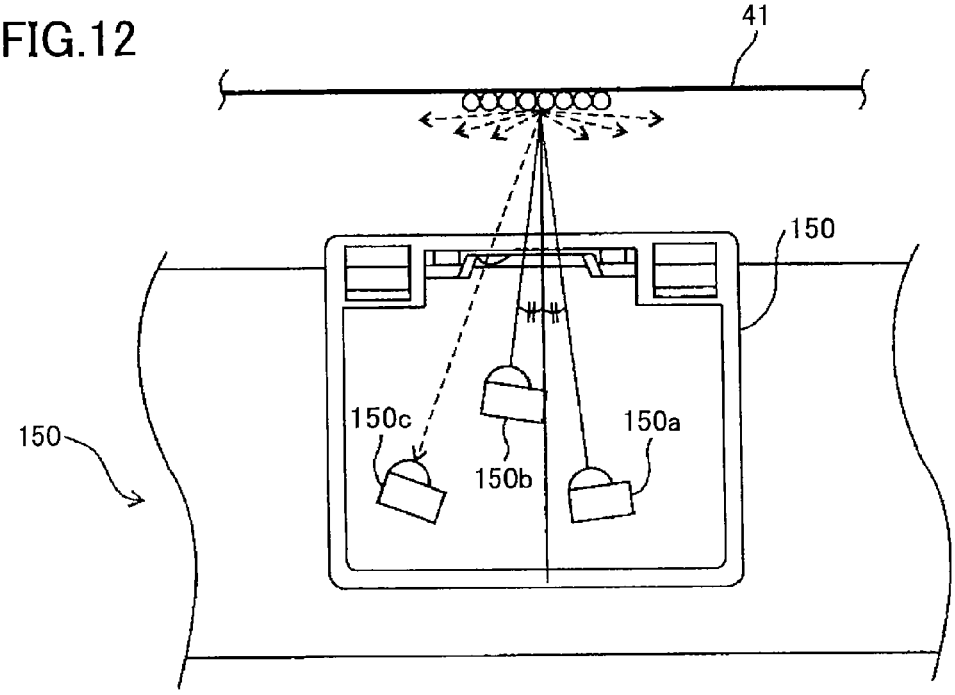
FIG. 12 is an enlarged configuration diagram illustrating an example of an optical sensor in the printer with an intermediate transfer belt according to the present embodiment.

As show in FIG. 1, of the entire region of the intermediate transfer belt 41 in the circumference direction, at a point of stretching over the nip entering roller 49, an optical sensor 150 is opposed from the front surface of the belt. FIG. 12 is an enlarged configuration diagram illustrating the optical sensor 150 with the intermediate transfer belt 41. The optical sensor 150 including a multi-reflection type optical sensor has an LED 150*a* as a light source, a regular reflection reception unit 150*b* and a diffuse reflection reception unit 150*c*. The optical sensor 150 receives a regular reflection light, which after being emitted from the LED 150*a* is regularly reflected on the surface of the intermediate transfer belt 41, at the regular reflection reception unit 150*b*, and outputs a voltage in response to a reception amount of the regular reflection light from the regular reflection reception unit 150*b*. Moreover, the optical sensor 150 receives a diffuse reflection light, which after being emitted from the LED 150*a* is diffusely reflected on the surface of the intermediate transfer belt 41, at the diffuse reflection reception unit 150*c*, and outputs a voltage in response to a reception amount of the diffuse reflection light from the diffuse reflection reception unit 150*c*. When a test toner image, which will be described later in detail, formed on the intermediate transfer belt 41 passes the position opposed to the optical sensor 150, the reception amounts of the regular reflection light and the diffuse reflection light, described above, represent optical characteristics of the test toner image. Moreover, when a background of the belt passes the opposed position, the reception amounts of the regular reflection light and the diffuse reflection light represent optical characteristics of the background of the belt.

Figure 13:
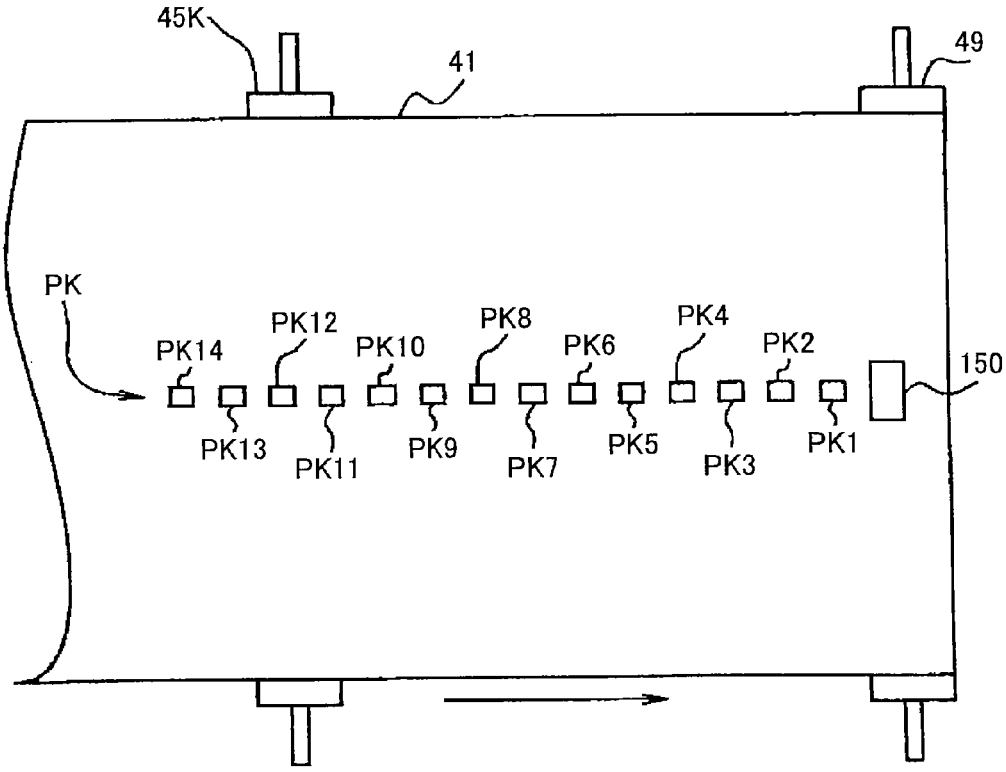
FIG. 13 is a plan view illustrating an example of the intermediate transfer belt and a K gradation pattern image formed on the belt according to the present embodiment.

The control device of the printer according to the present embodiment is configured so that a process control processing as follows is executed right after the power is ON, or every time a printing of a predetermined number of sheets is performed. In the process control processing Y, C, M and K gradation pattern images including Y, C, M and K toners, respectively, are formed. Each of the gradation pattern images includes plural test toner images, and is formed in a central portion on the intermediate transfer belt 41 in the belt width direction so that it passes the opposed position to the optical sensor 150. The K gradation pattern image PK, as an example, includes the following test toner images, as shown in FIG. 13. That is, the gradation pattern image PK includes fourteen K test toner images, i.e. a first K test toner image PK1, a second K test toner image PK2, a third K test toner image PK3, . . . , a fourteenth K test toner image PK14, in which a toner attraction amount gradually increases step by step. Output voltages from the optical sensor 150 when these K test toner images enter the opposed position to the optical sensor 150 are sent to the control device 100 via an I/O interface, and are stored in the RAM. As in the K toner, also for the Y, C and M toners, Y, C and M gradation pattern images PY, PC and PM including fourteen Y, C and M test toner images, respectively, are formed. Then, output voltages from the optical sensor 150 when the fourteen Y, C and M test toner images enter the opposed position to the optical sensor 150 are stored in the RAM. Meanwhile, FIG. 13 indicates the intermediate transfer belt 41 viewed from the lower part in the vertical direction to the upper part.

The control device 100, based on the output voltage from the optical sensor 150 stored in the RAM and on an algorithm stored in the ROM in advance, converts the output voltages for Y, C, M and K toners into Y, C, M and K toner attraction amounts per unit area, respectively, and stores them in the RAM.

Figure 14:
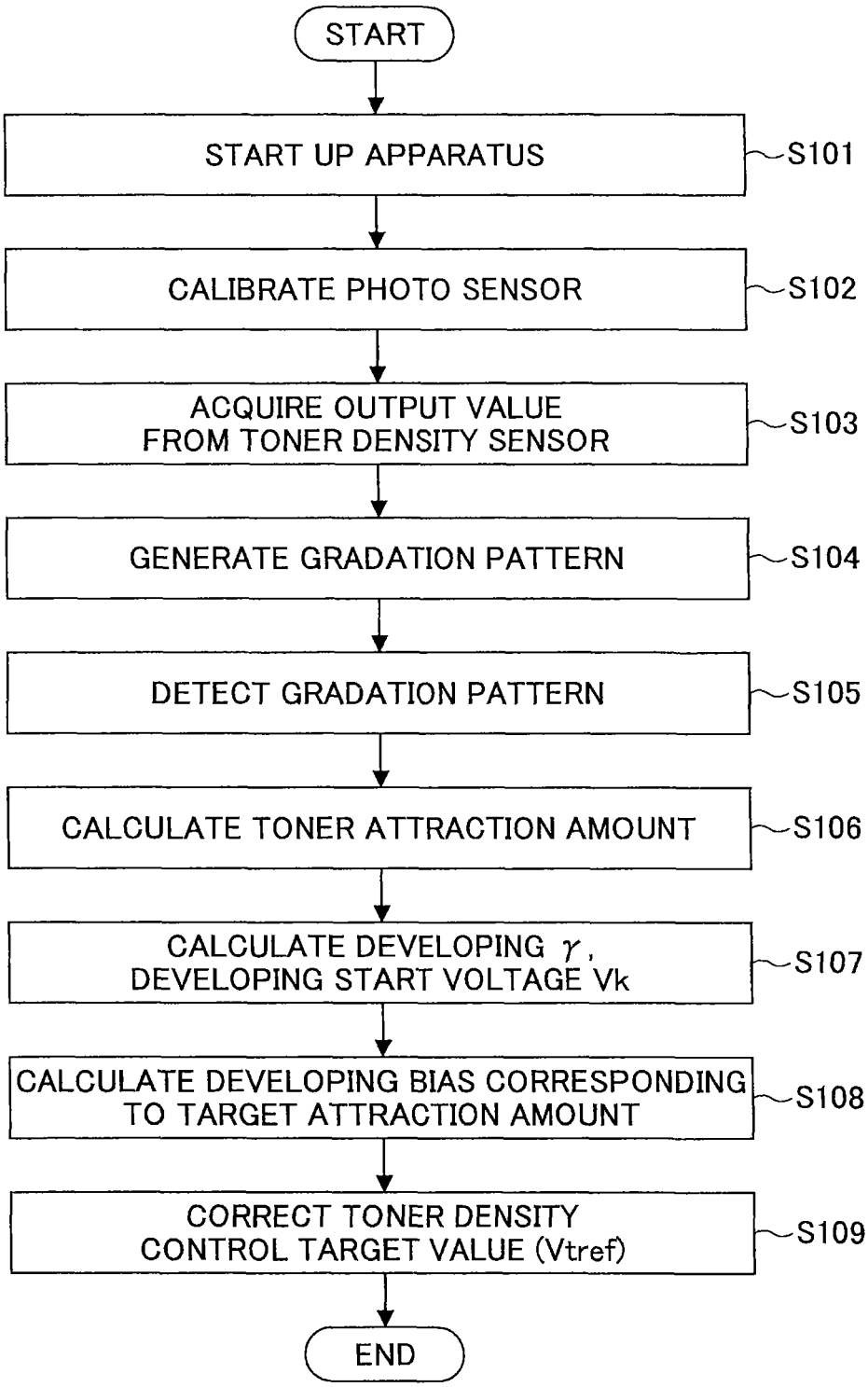
FIG. 14 is a flowchart illustrating an example of various processes executed in process control processing according to the present embodiment.

FIG. 14 is a flowchart illustrating various processes executed in the process control processing. The process control processing includes starting up an apparatus (step S101), calibrating a photo sensor (step S102), acquiring an output value from a toner density sensor (step S103), and generating a gradation pattern (step S104). Furthermore, the process control processing includes detecting the gradation pattern (step S105), calculating a toner attraction amount (step S106), calculating a developing bias corresponding to the target attraction amount (step S108) and correcting a toner density control target value (Vtref) (step S109).

In the processing of starting up the apparatus (step S101), drives of various motors and various devices start, and until the drives of them become stable the proceeding of the process waits. The optical sensor 150 changes an output from the LED and changes a sensitivity of the reception unit according to a change in temperature or time degradation. Accordingly, even when a constant electric current is continuously supplied to the LED, the output voltage value from the reception unit of the optical sensor 150 upon detecting a background of the belt may change temporally. Also due to a change over time in a surface characteristic of the belt, the output voltage value from the reception unit may change temporally. In this way, in performing the process control processing, a calibration processing for the photo sensor is performed so that a constant voltage is output from the reception unit upon detecting the background part of the intermediate transfer belt 41.

In the calibration processing for the photo sensor (step S102), for the optical sensor 150, a supply amount of electric current to the LED (amount of emission of LED) is adjusted so that the output voltage value from the regular reflection reception unit falls within a predetermined range. In the following, the output voltage value from the reception unit at this stage is denoted "background output value" Vsg. As the supply amount of electric current to the LED increases, the amount of emission from the LED increases and the amount of reception at the regular reflection reception unit increases. Inversely, as the supply amount of electric current to the LED decreases, the amount of emission from the LED decreases and the amount of reception at the regular reflection reception unit decreases.

Detailed processing in the calibration processing for the photo sensor at step S102 is as follows. That is, for each of the photo sensors, after a supply of electric current to an LED starts, the supply amount of electric current to the LED is adjusted so that the output voltage value from the regular reflection reception unit falls within a range of 4±0.5 V. In the following, the supply amount of electric current at this stage is denoted an LED current Ifsg.

The control device 100 searches for the LED current Ifsg that can bring the output voltage value from the regular reflection reception unit close to 4.0 V by using a binary search method. In the case where as a result of the binary search method an LED current that can bring the output voltage value from the normal reflection reception unit within the range of 4±0.5 V does not exist, it is determined to be a background output value Vsg adjustment error. When the background output value Vsg adjustment error occurs successively three times, the process proceeds to a process of an anomalous occurrence error, the apparatus is urgently stopped, and a message to inform it is displayed. Meanwhile, in the printer according to the present embodiment, in order to prevent a breakage of the LED due to an overcurrent supplied, an upper limit of the LED current Ifsg is set to be 30 mA.

The control device 100, by using the binary search method, brings the output voltage value from the regular reflection reception unit within the range of 4±0.5 V, and when the LED current Ifsg that can bring it close to 4.0 V, stores the LED current in the RAM. Then, from this point until the process control processing ends, the LED current Ifsg is supplied to the LED.

Meanwhile, in the case where the initial value of the LED current Ifsg is set to a significantly small value, it requires a long time to adjust the background output value Vsg. For this reason, the control device 100 reads out the value of the LED current Ifsg when the previous calibration processing is performed from the RAM, and employs it for the initial value. Then, under the condition of the initial value, background output values Vsg are measured at a predetermined time interval, and an average value of them is obtained. In the case where the average value falls within the range of 4.0±0.5 V, the LED current Ifsg is employed.

When the control device 100 ends the calibration processing (step S102) for the optical sensor 150 in this way, next, the control device 100 performs the acquisition processing for the output value from the toner density sensor (step S103). In this acquisition processing, for the Y, C, M and K toner density sensors (10Y, 10C, 10M and 10K), as described above, output voltage values Vt are acquired and stored in the RAM, respectively. The acquired output voltage values Vt from the Y, C, M and K toner density sensors will be used later for correcting the control target values for toner density for Y, C, M and K toners, respectively.

Next, the control device 100 performs the generation processing of gradation pattern images (step S104), and Y, C, M and K gradation pattern images are formed on the intermediate transfer belt 41. FIG. 13 illustrates only the K gradation pattern PK, out of the gradation patterns of the respective colors. In the generation processing of gradation pattern images (step S104), the Y, C, M and K gradation pattern images PY, PC, PM and PK are formed aligned in a line along the moving direction of the belt. Each of the gradation pattern images includes fourteen test toner images, and optical characteristics of the test toner images are detected by the optical sensor 150.

The sizes of each of the fourteen test toner images in the gradation pattern of each of the colors are as follows. That is, the length in the belt width direction is 10 mm, the length in the belt moving direction is 14.4 mm and the gap between the antecedent test toner image and the subsequent test toner image is 5.6 mm. The number of test toner images in the gradation pattern image is not limited to fourteen. However, the number falls preferably inside the range of distance between the centers of photoreceptors adjacent to each other. When a length of the gradation pattern image in the direction of the belt moving direction is greater than the distance between the centers of photoreceptors, it is not possible to start forming the gradation pattern image of each of the colors simultaneously. Therefore, in order not to overlap an end part of a preceding gradation pattern image with an apical part of the subsequent gradation pattern image, a forming timing needs to be delayed. According to the above processing, the operation time of the process control processing becomes longer.

In the printer according to the present embodiment, upon forming the gradation pattern image, regardless of the image density (toner attraction amount) of the test toner image, optical writing intensity for the latent image of the test toner image is set to be maximum (the intensity upon forming a solid image). Then, by making developing biases or charging biases different for the respective test toner images, the image densities of the respective test toner images are made different.

The printer according to the present embodiment, which detects the gradation pattern images of the respective colors only by one optical sensor 150, has the following advantages. That is, even in the case where an image density deviation occurs between an end part and the other end part in the belt width direction, without being affected by the image density deviation, the image density of the test toner image can be accurately detected. On the other hand, in the configuration where the gradation pattern images of the respective colors are formed at shifted positions from each other in the belt width direction and are detected by dedicated photo sensors, time for forming the gradation pattern images and for detecting them may be shortened, but they are affected by the image density deviation.

After the gradation pattern image of each of the colors is formed, the control device 100 executes the gradation pattern detection processing (step S105) and detects the toner attraction amount per unit area (image density) in the fourteen test toner images for each of the Y, M, C and K gradation pattern images. In the printer according to the present embodiment, for the test toner images of the K gradation pattern image, the toner attraction amount is detected by using only the regular reflection light amount. On the other hand, for the test toner images of the C, M and K gradation pattern images, the toner attraction amounts are detected by using the regular reflection light amount and the diffuse reflection light amount.

As described above, the gradation pattern images are formed so that the Y gradation pattern image is formed earlier than the other C, M and K gradation pattern images. A time from when the formation of the Y gradation pattern image starts to when the first test toner image of the Y gradation pattern image enters just below the optical sensor 150 (in the following, denoted as a detection time lag) is preliminarily determined by the following parameter or the like. That is, it is a process linear velocity upon executing the process control (velocity of the belt or the like) or a distance between the photoreceptor and the sensor. However, since the intermediate transfer belt 41 does not move exactly at the designed velocity and the distance between the photoreceptor and the sensor includes an error, the detection time lag also includes an error. Even when the greatest error that can be assumed occurs in the detection time lag, the control device 100 begins acquiring the output voltage value from the optical sensor 150 at a timing that can surely catch the head part of the Y gradation pattern image.

Next, the control device 100 executes calculation processing of the toner attraction amount (step S106). In this calculation processing, the toner attraction amount of the K test toner image in the K gradation pattern image is obtained as follows. That is, at first, the following quantities for the background output value from the normal reflection reception unit Vsg and the toner image output value Vsp are obtained according to the following formulas.

$$\Delta Vsg_reg = Vst_reg - Voffset_reg \quad \text{Formula 1}$$

$$\Delta Vsp_reg[n] = Vsp_reg[n] - Voffset_reg \quad \text{Formula 2}$$

In the above formulas, the character string "_reg" represents the output voltage value from the regular reflection reception unit. In the above formulas, for the background output value Vsg and the toner image output value Vsp, differences from the offset voltage Voffset are obtained. The offset voltage Voffset represents an output voltage value from the reception unit when the emission of the LED is turned off. Moreover, the argument "n" in the above formula represents the number of the K test toner image. That is, for all the fourteen K test toner images in the gradation pattern image, the differences are obtained. By obtaining the differences between the measured values and the offset voltage Voffset, an increase in the toner attraction amount of the K test toner image can be perceived.

Next, the control device 100 obtains a normalized value of the difference using the following formula.

$$\text{Normalized value } Rn[n] = \Delta Vsp_reg[n]/Vsg_reg \quad \text{Formula 3}$$

Then, the toner attraction amounts of the respective K test toner images are obtained based on the preliminarily stored algorithm showing a relation between the normalized value Rn and the toner attraction amount (graph, calculation formula, data table or the like).

Figure 15:
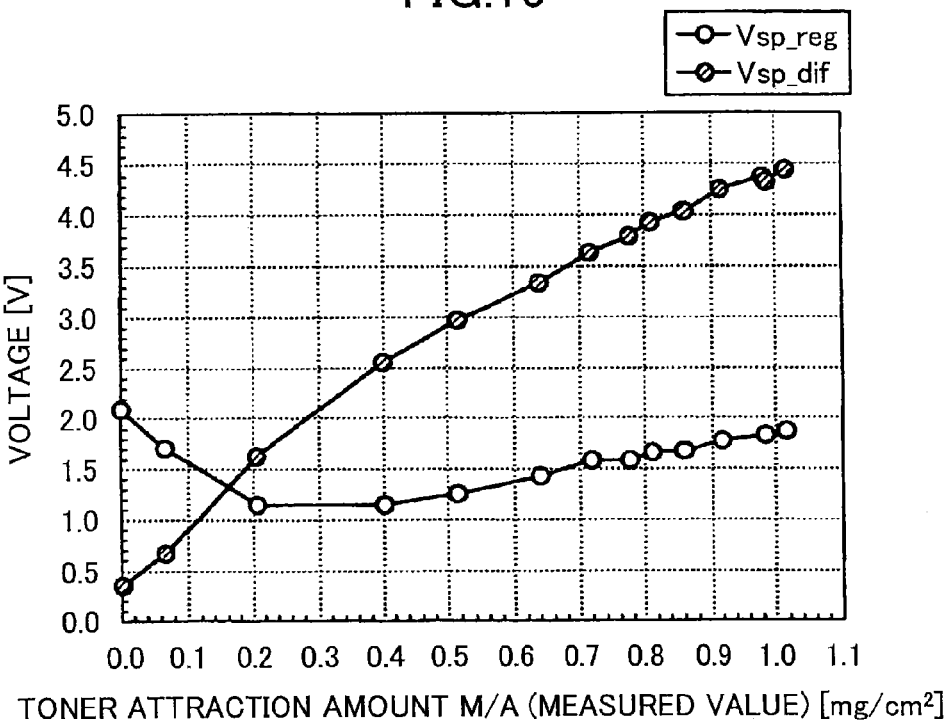
FIG. 15 is a diagram illustrating an example of a relation between an output voltage from a photo sensor and a toner attraction amount according to the present embodiment.

Moreover, the toner attraction amounts of the test toner images in the Y gradation pattern image, the C gradation pattern image and the M gradation pattern image are obtained as follows. FIG. 15 is a diagram illustrating the relation between the sensor output voltage and the toner attraction amount of the color test toner images. The control device 100 obtains, at first, differences between the toner image output value Vsp in the fourteen test toner images for each of the colors of Y, C and M and the offset voltage Voffset. Meanwhile, the character string "_dif" in the following formulas represents output voltage values from the diffuse reflection reception unit.

$$\Delta Vsp_reg\cdot[n] = Vsp_reg\cdot[n] - Voffset_reg \quad \text{Formula 4}$$

$$\Delta Vsp_dif\cdot[n] = Vsp_dif\cdot[n] - Voffset_dif \quad \text{Formula 5}$$

Next, in order to perform a correction for the toner image output value Vsp_dif from the diffuse reflection reception unit according to sensitivity of the diffuse reflection reception unit, a sensitivity correction coefficient α is obtained by the following formula.

$$\alpha=\min(\Delta Vsp_reg[n]/Vsp_dif\cdot[n]) \quad \text{Formula 6}$$

Figure 16:
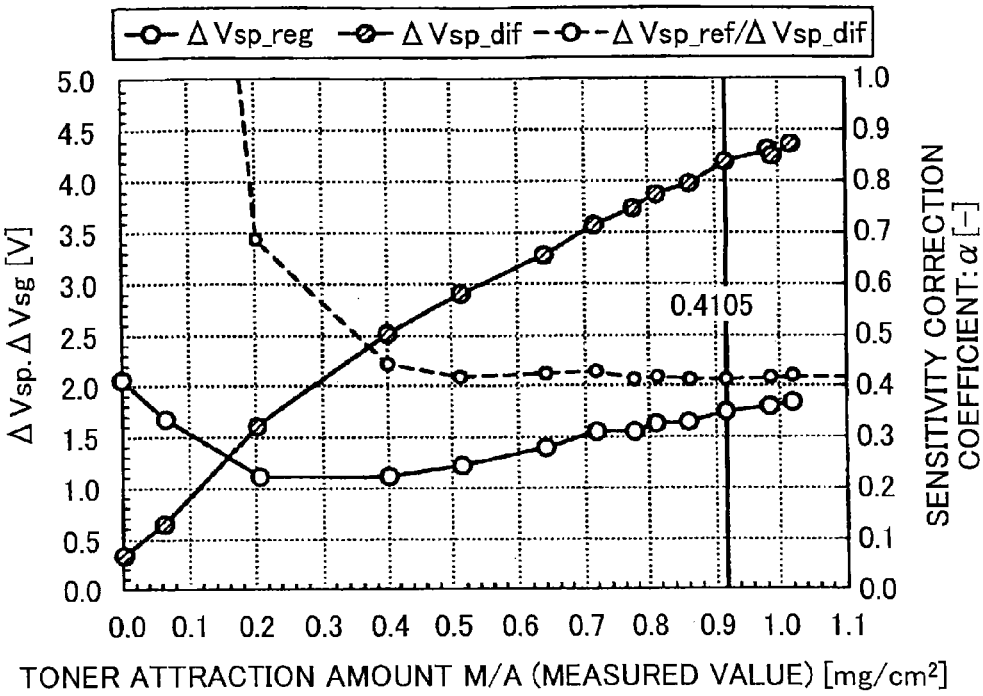
FIG. 16 is a diagram illustrating an example of a relation between a difference in a toner image output value and the toner attraction amount according to the present invention.

A ratio of the sensitivity correction coefficient α is obtained by the minimum, because it is previously known that the minimum of a regular reflection component in the toner image output value Vsp_reg from the regular reflection light reception unit is positive and almost zero. By multiplying the toner image output value Vsp_dif[n] from the diffuse reflection reception unit by the sensitivity correction coefficient α obtained in this way, the graph representing the relation between the difference of the toner image output value Vsp_dif and the toner attraction amount is corrected, as shown in FIG. 16.

Next, for the difference of the toner image output value Vsp_ref from the regular reflection reception unit, a diffuse reflection light component and a regular reflection light component are decomposed respectively as in the following formulas. Meanwhile, ΔVsp_reg_dif[n] in Formula 7 represents the diffuse reflection light component of the difference. Moreover, ΔVsp_reg_reg[n] in Formula 8 represents the regular reflection light component of the difference.

$$\Delta Vsp_reg\cdot_dif\cdot[n]=\Delta Vsp_dif\cdot[n]\times\alpha \quad \text{Formula 7}$$

$$\Delta Vsp_reg\cdot_reg\cdot[n]=\Delta Vsp_reg\cdot[n]-\Delta Vsp_reg\cdot_dif\cdot[n] \quad \text{Formula 8}$$

Figure 17:
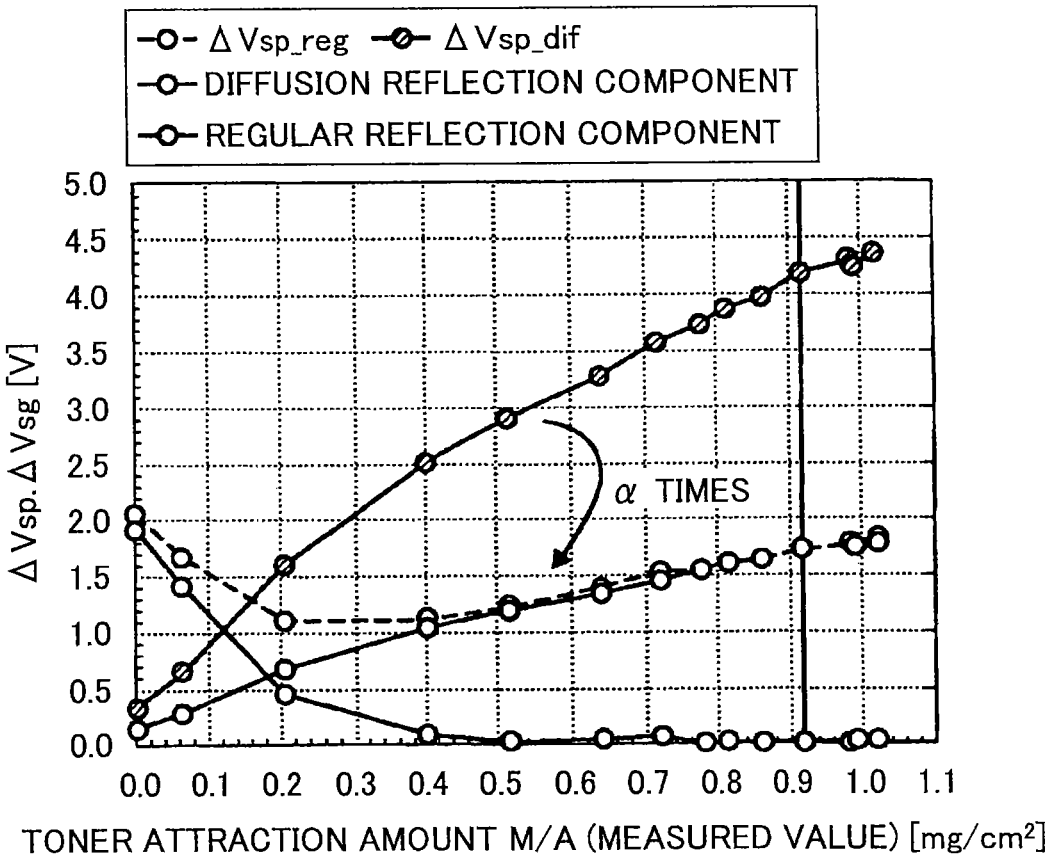
FIG. 17 is a diagram illustrating an example of a relation between a difference in a toner image output from a regular reflection light reception unit of the photo sensor and the toner attraction amount according to the present embodiment.

In this way, from the difference of the toner image difference value Vsp_reg from the regular reflection light reception unit, the diffuse reflection light component is separated, and a pure regular reflection light component is extracted. Accordingly, as shown in FIG. 17, for example, the graph representing the relation between the difference of the toner image output value Vsp_reg from the regular reflection light reception unit and the toner attraction amount is corrected to the one that reflects only a pure regular reflection component.

Next, by the following formula, for the regular reflection reception unit, fourteen regular reflection components corresponding to the fourteen test toner images, respectively, are normalized.

$$\text{Normalized value } \beta[n]=-AVsp_reg\cdot_reg/\Delta Vsg_reg\cdot_reg(=\text{exposure ratio of background part of the transfer belt}) \quad \text{Formula 9}$$

Moreover, by the following formula, for the diffuse reflection reception unit, a diffuse light output component of the background output value Vsp=dif is removed from the toner image output value Vsp_dif.

$$\Delta Vsp_dif'=[\text{diffuse output voltage}]-[\text{belt background part output}]\times[\text{normalized value of regular reflection component}]=\Delta Vsp_dif(n)-\Delta Vsg_dif\times\beta(n) \quad \text{Formula 10}$$

As described above, in a low toner attraction amount region having sensitivity for the regular reflection light, from the regular reflection light, only a regular reflection light component which can unambiguously express a relation with the toner attraction amount is extracted. When the "diffuse reflection light component directly reflected from the belt background part" is removed from the diffuse reflection light, a sensitivity correction for the diffuse reflection light output is performed based on them. The sensitivity correction is performed in order to perform the following correction. That is, it is a correction related to a solid error in the sensitivity of the LED and the reception unit, and a correction related to a temperature characteristic or a time degradation characteristic of the LED and the reception unit.

Figure 18:
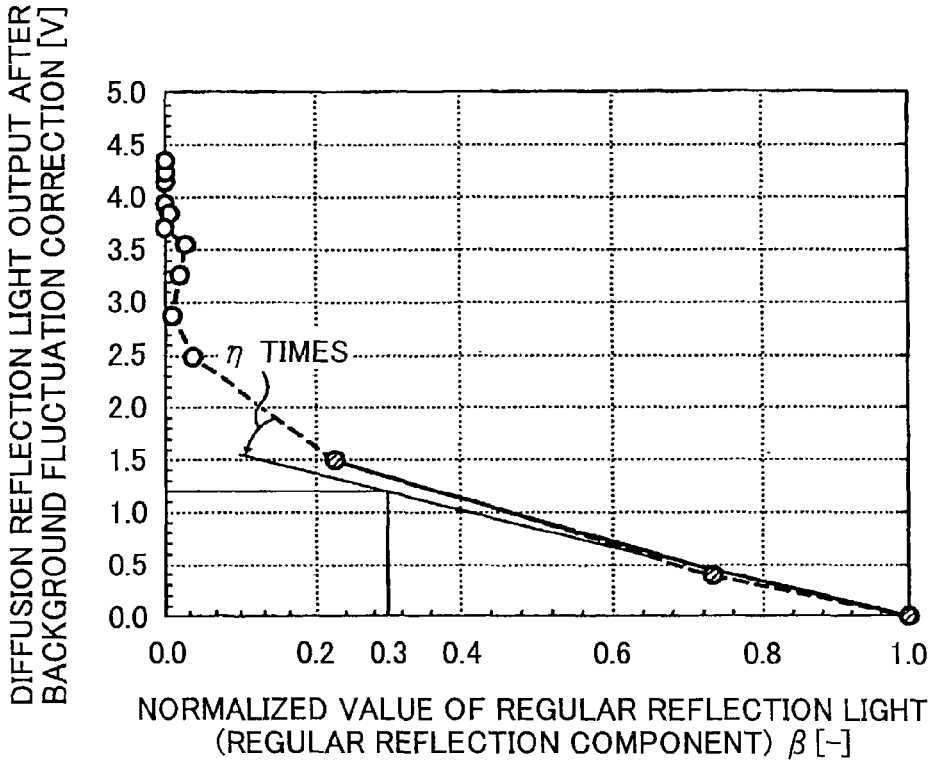
FIG. 18 is a diagram illustrating an example of a relation between a normalized value of a regular reflection component of a regular reflection light unit of the photo sensor and an output of diffuse reflection light after a fluctuation correction for background part according to the present embodiment.

This correction is performed as follows. That is, as shown in FIG. 18, for the "normalized value of the regular reflection component of the regular reflection light unit", diffuse reflection light output after the background part fluctuation correction is plotted, from a linear relation in the low toner attraction amount region, sensitivity of the diffuse reflection light output is obtained, and a correction is performed so that this sensitivity is an aimed sensitivity determined preliminarily. The sensitivity of diffuse reflection light output is an inclination of the line shown by a graph in FIG. 18, and it is corrected by calculating a correction coefficient by which the present inclination is multiplied, so that a diffuse reflection light output after the background part fluctuation correction for a certain normalized value becomes a predetermined value. The inclination of the line is obtained by using the least square method.

A method of approximating a point plotted on a graph is as follows. That is, for the "normalized value of the regular reflection component of the regular reflection light", a plot curve on which diffuse light outputs after the background part fluctuation correction are plotted is approximated by a polynomial (approximated by a quadratic expression), and a sensitivity correction coefficient η is calculated. In more detail, at first, the plot curve is approximated by an approximated quadratic expression ($y=\xi 1x^2+\xi 2x+\xi 3$), and the coefficients ξ1, ξ2 and ξ3 are obtained by using the least square method as in the following formulas. Meanwhile, an integer "m" in the following formulas represents a number of data. Moreover, x[i] is a normalized value of a regular reflection component of the regular reflection light. Moreover, y[i] represents a diffuse light output after the background part fluctuation correction. The range for x used in the calculation is, for example, assumed to be $0.1\leq x\leq 1.00$.

$$\xi_1\sum_{i=1}^{m} x[i]^2+\xi_2\sum_{i=1}^{m} x[i]^1+\xi_3\sum_{i=1}^{m} x[i]^0=\sum_{i=1}^{m} y[i]x[i]^0 \quad \text{Formula 11}$$

$$\xi_1\sum_{i=1}^{m} x[i]^3+\xi_2\sum_{i=1}^{m} x[i]^2+\xi_3\sum_{i=1}^{m} x[i]^1=\sum_{i=1}^{m} y[i]x[i]^1 \quad \text{Formula 12}$$

$$\xi_1\sum_{i=1}^{m} x[i]^4+\xi_2\sum_{i=1}^{m} x[i]^3+\xi_3\sum_{i=1}^{m} x[i]^2=\sum_{i=1}^{m} y[i]x[i]^2 \quad \text{Formula 13}$$

Next, the sensitivity correction coefficient η which makes a normalized value a calculated by the plot line approximated as above a predetermined value b is obtained by the following formula.

$$\eta=b/(\xi_1 a^2+\xi_2 a+\xi_3) \quad \text{Formula 14}$$

Moreover, as in the next expression by multiplying the diffuse light output after the background part fluctuation correction obtained by Formula 10 as above by the sensitivity correction coefficient η the relation between the toner attraction amount and the diffuse output is corrected to be a preliminarily determined relation. Meanwhile, ΔVsp_dif' in the next expression represents the diffuse light output obtained by Formula 10 as above.

$$\Delta Vsp_dif''=[\text{diffuse light output after background part fluctuation correction}]\times[\text{sensitivity correction coefficient: }\eta]=\Delta Vsp_dif[n]'\times\beta \quad \text{Formula 15}$$

According to the correction as above the output fluctuation in the LED or the reception unit due to temperature change, time degradation or the like is suppressed, and the relation between the output voltage value from the reception unit and the toner attraction amount can be corrected to an unambiguous relation.

Next, by using an attraction amount conversion table ΔVsp_dif" is converted into a toner attraction amount. By referring to the attraction amount conversion table based on the output voltage value after correction, the output voltage value can be converted into the toner attraction amount.

Figure 19:
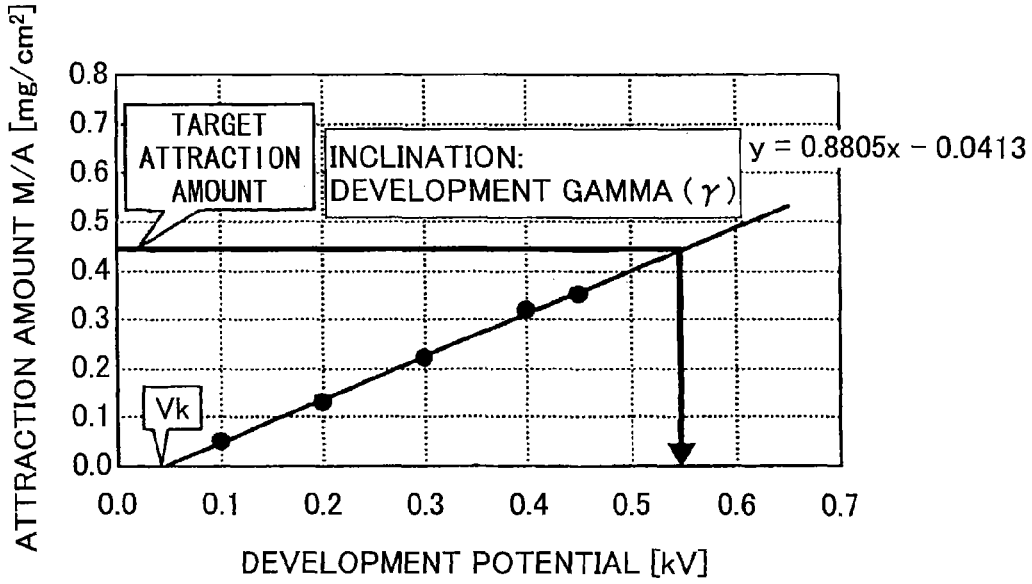
FIG. 19 is a diagram illustrating an example of a relation between a toner attraction amount and a developing potential according to the present embodiment.

When toner attraction amounts of the respective fourteen test toner images for the gradation pattern image for each of the colors as above, next a calculation processing for a developing bias which is a target attraction amount is performed (step S108). Specifically, at first as shown in FIG. 19 an approximated line indicating a relation between a developing potential upon developing the test toner image (potential difference between an electrostatic latent image and the developing sleeve) and a toner attraction amount of the test toner image is obtained by using the least square method. Then, the inclination of the approximated line is obtained as a developing γ. Moreover, an x-intercept of the approximated line is obtained as a developing start voltage Vk.

Next, based on the approximated line, a developing potential in which a target toner attraction amount (in the example shown in the drawings, 4.5 mg/cm$^2$) is obtained is obtained. Then, from the result a developing bias in which the target toner attraction amount is obtained is calculated (developing bias Vb−V=(developing potential−|latent image potential|)×(−1)). Meanwhile, a charging bias Vc during forming an image is preliminarily determined so that a background part potential of the photoreceptor is a value where a magnetic carrier in the developing agent does not become attached to the photoreceptor.

When the developing bias Vb is obtained, the developing bias Vb as a control parameter upon forming images subsequently is corrected to the same value as the obtained value. Next, correction processing for the toner density control target value (Vtref) is performed (step S109). Based on the developing γ and the toner density sensor output Vt the toner density control target value Vtref is corrected. Specifically, a solution of "Δγ=developing γ detected value−developing γ target value" is obtained. The developing γ target value is preliminarily determined for every apparatus. For example, it is about 1.0 mg/cm$^2$/−kV. This value indicates that when the developing potential is 1−kV toner of 1.0 mg/cm$^2$ is attached to the photoreceptor. When the developing start voltage is 0−kV and the target toner attraction amount is 0.5 mg/cm$^2$ the developing potential of 500−V is required. Since the developing potential −V is obtained by "Vb−Vl (latent image potential)", when the latent potential Vl=50−V, the developing bias Vb is 550−V. Since when Δγ exceeds a predetermined value, the developing bias Vb may exceed a settable range or a failed image may occur, the toner density control target value Vtref is corrected so that Δγ falls within a target range. However, when the toner density sensor output Vt is significantly different from the toner density control target value Vtref, the correction is not performed.

For example, assume that Δγ≥0.30 mg/cm$^2$/−kV and Vt−Vtref≥0.2 V. In this case, since Vtref is equal to Vt−0.2 V, the toner density control target value Vtref is corrected so as to make the toner density less than the present value. Moreover, for example, assume that Δγ≤0.30 mg/cm$^2$/−kV and Vt−Vtref≤0.2 V. In this case, since Vtref is equal to Vt+0.2 V, the toner density control target value Vtref is corrected so as to make the toner density greater than the present value. In a case other than the above two cases the present value of the toner density control target value Vtref is maintained.

By periodically performing the process control processing as above it is possible to form a toner image the image density of which is close to a target value over a long period regardless of an environmental fluctuation. However, when an environment or a toner charge quantity changes drastically, in a period until the next process control processing is performed an excessive image density or an insufficient image density may occur. Especially, when in a successive print mode in which images are formed on plural recording sheets successively a temperature inside the apparatus rises drastically, or the toner charging quantity inside the developing apparatus becomes larger or smaller drastically, the excessive image density or the insufficient image density may be easily generated.

Then, conventionally an image processing apparatus that performs the following target value correction processing in a successive print mode has been known. That is, in an interspace corresponding region on the intermediate transfer belt 41 (a region corresponding to an interspace between a preceding recording sheet and a subsequent recording sheet in the successive print mode) a patch-shaped solid toner image (in the following denoted a solid patch image) is formed. And, image density of the solid patch image is detected by an optical sensor unit, and the result of detection and target image density are compared. Then, by correcting the toner density control target value Vtref by an amount corresponding to a difference between them the target image density is obtained. According to the configuration as above in the successive print mode even when a drastic change in the temperature or in the toner charge quantity occurs the target image density can be obtained.

However, in the above configuration there has been a problem that by forming the solid patch image consumption of toner which a user does not intend occurs and a running cost increases.

Next, a characteristic configuration of the printer according to the present embodiment will be explained.

Figure 20:
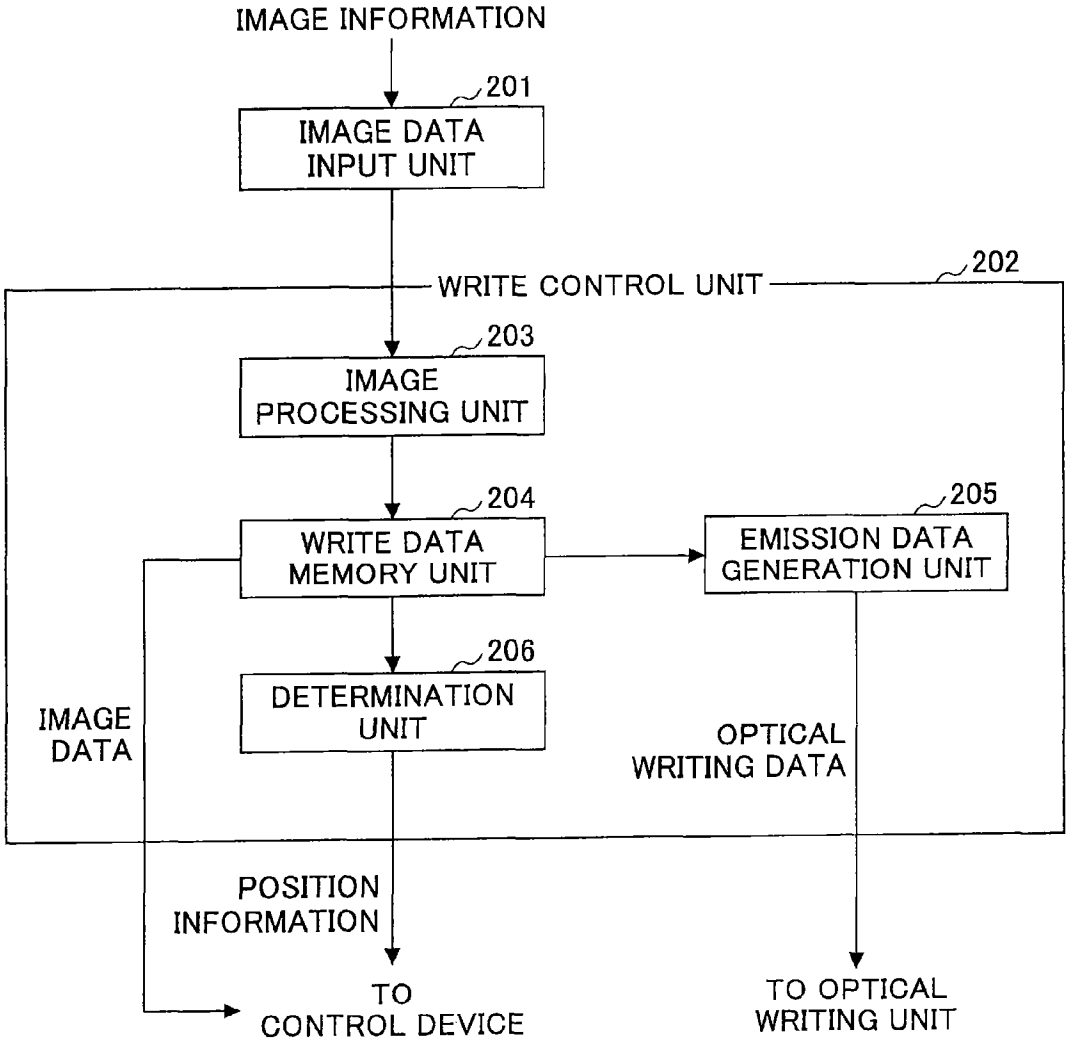
FIG. 20 is a block diagram illustrating an example of a part of the electric circuit of a printer according to the present embodiment.

FIG. 20 is a block diagram illustrating a part of an electric circuit of the printer according to the present embodiment. In FIG. 20, to an image data input unit 201 as an image information acquisition means image information sent from an external personal computer, a scanner or the like is input. The image information input to the image data input unit 201 is forwarded to a write control unit 202 that controls driving of the above-described optical writing unit 20.

The write control unit 202 includes an image processing unit 203, a write data memory unit 204, an emission data generation unit 205, a determination unit 206 and the like. The image processing unit 203 performs predetermined image processing for the input image information. Moreover, the write data memory unit 204 temporarily stores image information after the image processing. Moreover, the emission data generation unit 205 after generating emission data for controlling driving a laser diode in the optical writing unit 20 based on the image information after the image processing outputs the emission data to a laser drive circuit which is not shown. Moreover, the determination unit 206 for a predetermined region in a toner image formed based on the image information after the image processing determines whether it is suitable for use for detecting the image density. When it is suitable for use, the determination unit 206 outputs suitability region data to the control device 100.

Figure 21:
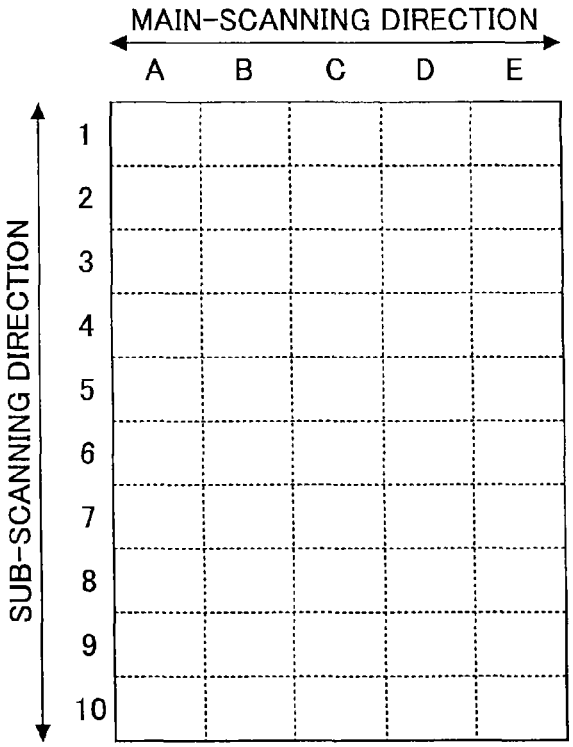
FIG. 21 is a pattern diagram for explaining segmented regions on a paper according to the present embodiment.

The determination unit 206 acquires image information for one sheet by dividing into plural segmented regions. FIG. 21 is a pattern diagram for explaining segmented regions on the sheet. In FIG. 21, the main-scanning direction is a direction along a line of a rotational axis of the photoreceptor. Moreover, the sub-scanning direction is the same direction as the conveying direction of the paper. The determination unit 206 defines plural segmented regions dividing a region of one sheet in the main-scanning direction and in the sub-scanning direction respectively as shown in FIG. 21. Meanwhile, FIG. 21 shows an example as a matter of convenience in which the paper is divided into five pieces in the main-scanning direction and into ten pieces in the sub-scanning direction. However, actually the number of divisions is larger than the above. For example, in a model that accepts a paper of the A3 size and a maximum the length of the photoreceptor in the rotational axis direction is a little greater than 300 mm. Since a size of the segmented region is preferably about the same as a region of the object for detecting the toner attraction amount by the optical sensor 150, it is about 10 mm×10 mm in the printer in the present embodiment. Therefore, a paper of the A3 size is divided into 30 pieces in the main-scanning direction and into 42 pieces in the sub-scanning direction (420 mm/42=10 mm). For the determination unit 206, for example in the example of FIG. 21, the image information of one sheet is acquired in the order of A1, B1, C1, D1, E, A2, . . . for the respective segmented regions. Then, only for the segmented region in the predetermined row position it is determined whether it is suitable for a region for use for detecting image density. The predetermined row position is specifically a row position which is the same position at which the optical sensor 150 is arranged in the main-scanning direction. For example, in the case where the optical sensor 150 is arranged so as to detect a toner attraction amount of a test toner image formed on a position of the row C in FIG. 21, the predetermine row position is the row C. Therefore, for each of the 10 segmented regions of C1 to C10, it is determined whether it is suitable for a region for use for detecting a toner attraction amount (image density). In the following, it is explained for the case where the predetermined row position is the row C as an example.

The determination whether it is suitable for use for detecting a toner attraction amount is performed based on density of recording pixels. Specifically, since an area $cm^2$ of the segmented region is a value obtained by dividing a size of paper $cm^2$ by a division number of the segmented regions, it is a preliminarily determined value for every paper size. For example, in the case of dividing a paper of the A3 size into 1260 pieces (30×42 division), an area of each of the segmented regions is "42 cm×29.7 cm/1260=0.99 $cm^2$".

Moreover, a number of pixels in each of the segmented regions is preliminarily determined. For example, in the case of dividing a paper of the A3 size into 1260 pieces, "234 [dot]×236 [dot]=55224 [dot]". The determination unit 206 stores the numbers of division in the main-scanning direction and in the sub-scanning direction and the number of pixels in the segmented region for every size of paper.

The density of recording pixels is a value indicating a fraction of pixels on which dots are formed out of all the pixels in the segmented region. A body obtained by multiplying the result of dividing a number of the pixels on which dots are formed by the number of pixels in the segmented region by 100 is a recording pixel density percent [%]. In the case where the recording pixel density is greater than or equal to a predetermined value (for example greater than or equal to 95%), it would be fair to say that a solid image is formed in an almost entire region of the segmented region.

Then, the determination unit 206 calculates the density of recording pixels for each of the segmented regions of C1 to C10 based on the recording pixel number acquired from the write data memory unit 204 and the preliminarily stored pixel number of the segmented region. When the result of calculation is greater than or equal to a predetermined value it is determined that the segmented region is suitable for use for detecting a toner attraction amount. On the other hand, in the case where the result of calculation is less than the predetermined value it is determined that the segmented region is not suitable for use for detecting a toner attraction amount.

The above-described determination is performed in the order of the segmented region C1, segmented region C2, . . . , the segmented region C10. In the case where the segmented region suitable for use for detecting is found during the above process further determination is not performed.

Figure 22:
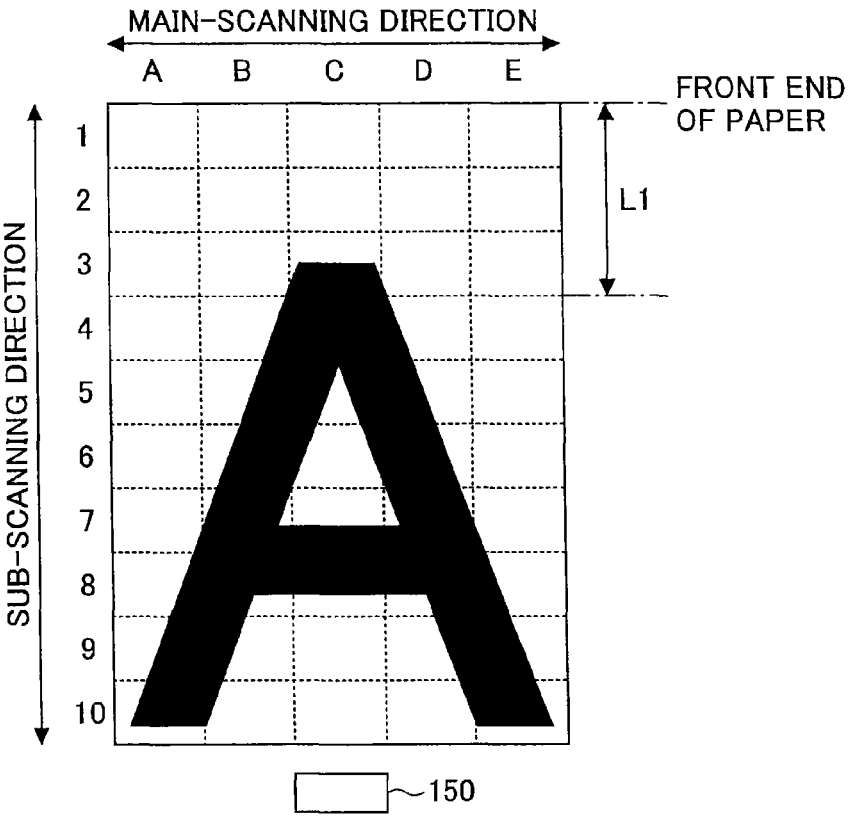
FIG. 22 is a pattern diagram for explaining an example of a positional relationship between the segmented regions and the optical sensor according to the present embodiment.

FIG. 22 is a pattern diagram for explaining a positional relationship between the segmented regions and the optical sensor 150. As shown in FIG. 22, assume that an image of a large alphabet character "A" is formed covering most part of the region of the paper. The determination unit 206 while acquiring image information of the segmented regions C1 to C10 sequentially determines for each of the segmented regions whether it is suitable for use for detecting a toner attraction amount. As shown in FIG. 22, since the segmented region C1 is a non-image region over the entire region the density of recording pixels is 0% and it is determined that it is not suitable for use for detecting. Moreover, since also the segmented region C2 a non-image region the density of recording pixels is 0% and it is determined that it is not suitable for use for detecting. Moreover, the segmented region C3 includes a solid image part of a certain size, but the density of recording pixels is 70%. Since the density of recording pixels is less than the threshold (for example 95%), it is determined that it is not suitable for use for detecting. Moreover, since the segmented region C4 is a solid image in the entire region as shown in FIG. 22, the density of recording pixels is 100% and it is determined that it is suitable for use for detecting. The determination unit 206 ends the process of determination at this stage and does not perform the determination further for the segmented regions C5 to C10. Then, the positional information on the segmented region C4 is sent to the control device 100.

As the positional information as shown in FIG. 22 information of a distance L1 between an front end of the paper and a front end of the segmented region is sent. The distance L1 is calculated based on a length of the segmented region in the sub-scanning direction (in the following denoted sub-scanning segmentation length) and a line number of the segmentation region which is determined to be suitable for use for detecting. In more detail, the distance L1 is obtained by multiplying the sub-scanning segmentation length by the line number decremented by one. In the example shown in FIG. 22 the line number of the segmented region which is determined to be suitable for use for detecting is four. The determination unit 206 obtains the distance L1 by multiplying the sub-scanning segmentation length by three and sends the result to the control device 100.

When an image of each page is optically written on the photoreceptor, a writing start signal is generated. The writing start signal is sent from the write control unit 202 to the control device 100. In the following a time from when the control device 100 receive the writing start signal to when a front end of an image part in the segmented region C4 in the toner image on the intermediate transfer belt 41 enters a region opposed to the optical sensor 150 is denoted a "region entry time". The "region entry time" can be obtained according to a predetermined calculation expression. Specifically, since a time from when the writing start signal is generated to when the front end of the paper enters a position opposed to the optical sensor 150 is determined by the process linear velocity, when the process linear velocity is a constant the paper front end entry time is also a constant. A result of dividing the distance L1 by the process linear velocity is a time required from when the paper front end enters the position opposed to the optical sensor 150 to when the front end of the segmented region which is a target enters the opposed position. Therefore, an expression of adding the result of dividing the distance L1 by the process linear velocity to the paper front end entry time is the above-mentioned predetermined calculation expression.

The control device 100 upon receiving the information of the distance L1 from the determination unit 206 calculates the "region entry time" using the calculation expression. Then, at timing when the "region entry time" elapses from the reception of the writing start signal a sampling is performed for outputs from the optical sensor 150. Then, based on the result of the sampling a toner attraction amount of the solid image part formed in the segmented region C4 is calculated and the toner control target value Vtref is corrected based on the result of the calculation.

In the configuration described above a correction amount for the toner control target value Vtref as a control parameter is calculated based on the result of detecting the toner attraction amount of the region which is suitable for use for detecting a toner attraction amount in a toner image formed based on an instruction from a user. Then, without forming a dedicated solid patch image for detecting a toner attraction amount in the interspace corresponding region on the intermediate transfer belt 41 the toner control target value Vtref can be corrected appropriately. Accordingly, an inadequacy in the image density due to a fluctuation of an environment and a charge quantity of toner can be suppressed with a lower cost than that of the related art.

Figure 23:
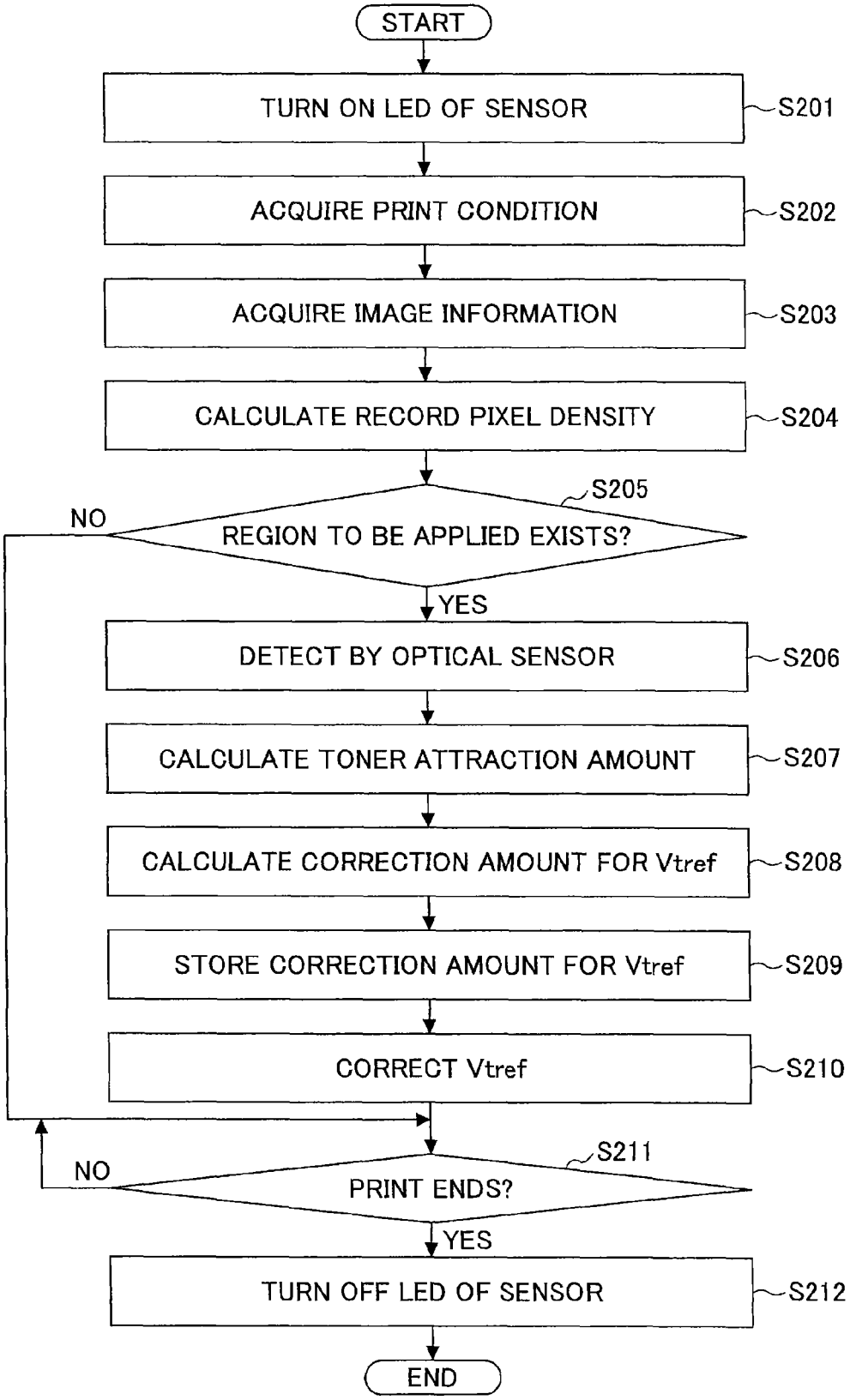
FIG. 23 is a flowchart illustrating an example of a process flow of simple correction processing for a target value executed in the printer according to the present embodiment.

FIG. 23 is a flowchart illustrating a process flow of simple correction processing for a target value executed in the printer according to the present embodiment. The simple correction processing for a target value is processing of correcting the toner control target value Vtref based on the toner attraction amount of the solid part in the successive print mode. It is called the simple correction processing for the target value since it is simpler processing than the process control processing.

When the simple correction processing for the target value begins, the LED in the optical sensor 150 is turned on (step S201). Specifically, it is put into a state where a toner attraction amount can be detected by turning on the LED after the shutter of the optical sensor is opened and the LED is exposed at the same time as a preparation for starting up the apparatus in order to start a print operation is performed.

Next, a print condition is acquired (step S202). The print condition includes the process linear velocity, a wiring resolution, a size of paper or the like. When these print conditions are acquired, information on the recording pixel number (image information) for every segmented region is acquired (step S203). Then, for the segmented region C4 density of recording pixels is calculated based on the recording pixel number and a number of pixels of the segmented region (step S204). It is determined whether the segmented region is suitable for use for detecting a toner attraction amount based on the result of calculation (step S205). When in this determination a segmented region suitable for use for detecting a toner attraction amount does not exist (step S205: NO), the printing ends (step S211) the LED in the optical sensor 150 is turned off (step S212) and the print job ends.

On the other hand, when there is a segmented region suitable for use for detecting a toner attraction amount out of plural segmented regions of the row C (step S205: YES) after the segmented region is detected by the optical sensor 150 (step S206) the toner attraction amount is calculated based on the result of detection (steps S207). Meanwhile, a method of converting the detection result of the optical sensor 150 into the toner attraction amount is the same method as the process control processing. When the toner attraction amount is calculated a correction amount for the toner density control target value Vtref is calculated based on a difference between the result of calculation for the toner attraction amount and the target attraction amount (step S208). When the result of calculation is greater than the target attraction amount the correction amount is obtained so as to reduce the toner attraction amount by an amount corresponding to the difference. Moreover, when the result of calculation is less than the target attraction amount the correction amount is obtained so as to increase the toner attraction amount by the amount corresponding to the difference. When the correction amount is obtained in this way the result is stored (step S209) and the toner density control target value Vtref is corrected (step S210). When the print ends (step S211: YES) the LED of the optical sensor 150 is turned off (step S212) and the print job ends.

In the simple correction processing for the target value described above a series of flows of steps S206 to S210 function as a first control parameter processing for correcting the toner density control target value Vtref as a control parameter based on the result of detection for the toner attraction amount. In the printer according to the present embodiment separately from the simple correction processing for the target value provided with the first control parameter processing as above a process control processing a flow of which is shown in FIG. 14 is executed. The process control processing functions as a second control parameter correction processing for correcting the developing bias Vb which is a control parameter based on the result of detection for the toner attraction amount (image density) for plural test toner images.

Figure 24:
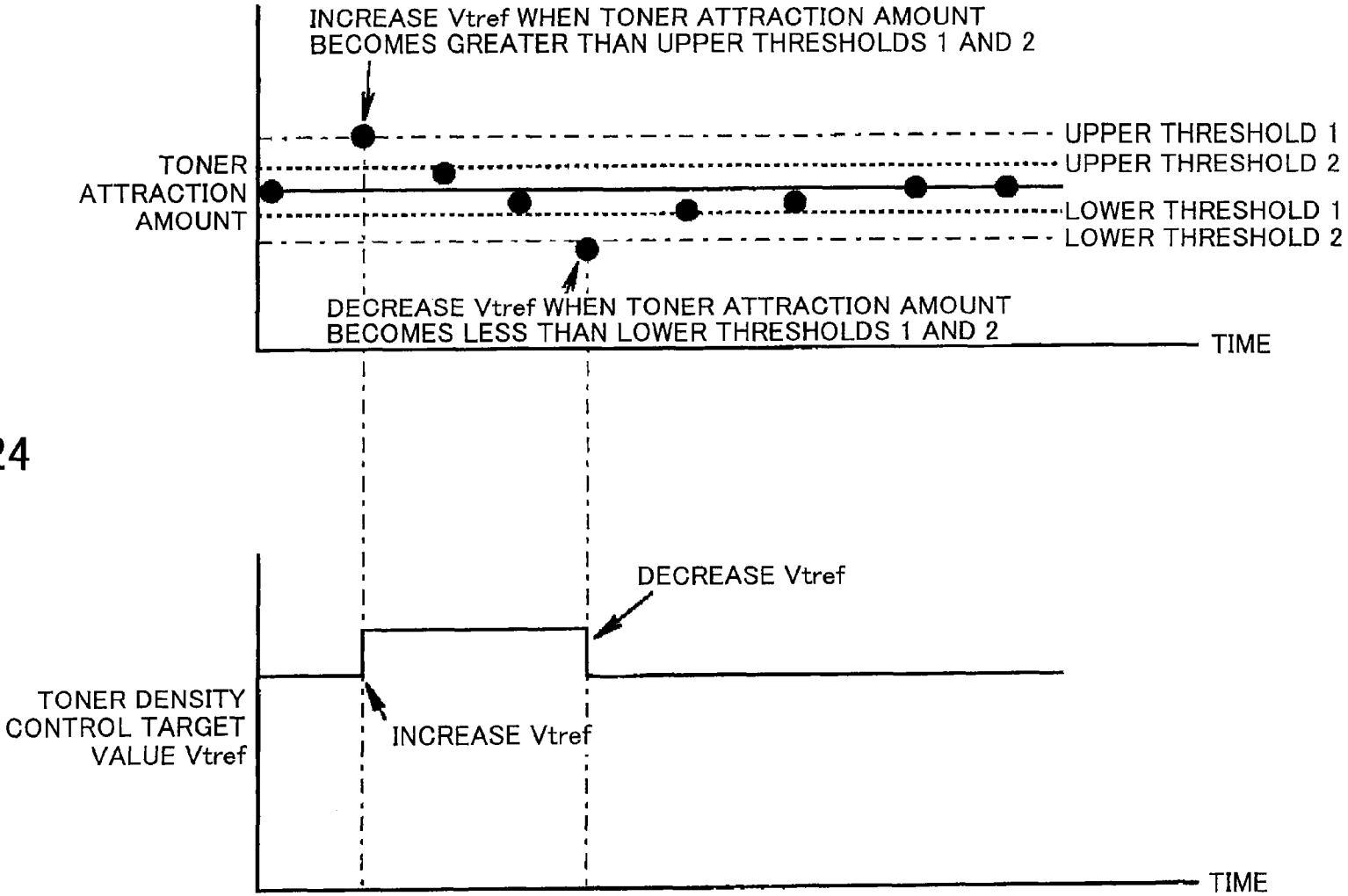
FIG. 24 is a pattern diagram for explaining an example of a relation between a result of detecting the toner attraction amount and a correction amount of the toner density control target value Vtref according to the present embodiment.

Specifically, the toner density control target value Vtref is corrected according to the following method which will be exemplified as follows. That is, as shown in FIG. 24 in the case where a toner attraction amount of a segmented region is greater than the target attraction amount the toner density control target value Vtref is corrected to a greater value. This means that the target value of the toner density is made less than the previous value. This is because the toner density control target value Vtref is a target value of an output voltage from the optical sensor 150 and it shows that as the output voltage increases the toner density decreases. Moreover, in the case where the toner attraction amount of the segmented region is less than the target attraction amount the toner density control target value Vtref is corrected to a smaller value. This means that the target value of the toner density is made greater than the previous value.

As shown in FIG. 24 for the toner attraction amount two upper threshold values including an upper threshold value 1 and an upper threshold value 2 which is greater than the upper threshold value 1 and two lower threshold values including an lower threshold value 1 and an lower threshold value 2 which is less than the lower threshold value 1 may be provided. Then, as shown in FIG. 25 a correction amount for the toner density control target value Vtref is preferably determined based on in which range the toner attraction amount is for the thresholds.

Specifically, in the case where the toner attraction amount of the segmented region exceeds the upper threshold value 2, i.e., it is substantially greater than the target attraction amount, by making the toner density control target value Vtref greater by 0.1 V the toner density is made lower. Accordingly, the toner attraction amount is made lower and is made closer to the target attraction amount. Meanwhile, the developing bias is a minus polarity. Moreover, in the case where the toner attraction amount of the segmented region is less than the upper threshold value 2 and greater than or equal to the upper threshold value 1, i.e., it is slightly greater than the target attraction amount, by making the toner density control target value Vtref greater by 0.05 V the toner density is made a little lower. Accordingly, the toner attraction amount is made lower and is made close to the target attraction amount. Moreover, in the case where the toner attraction amount of the segmented region is greater than the lower threshold 1 and less than or equal to the upper threshold value 1, since the target toner attraction amount is basically obtained the correction for the toner density control target value Vt is not performed. Moreover, in the case where the toner attraction amount of the segmented region is less than the lower threshold value 1 and greater than or equal to the lower threshold value 2, i.e., it is slightly less than the target attraction amount, by making the toner density control target value Vtref less by 0.05 V the toner density is made a little greater. Accordingly, the toner attraction amount is made greater and is made close to the target attraction amount. Moreover, in the case where the toner attraction amount of the segmented region is less than the lower threshold value 2, i.e., it is substantially less than the target attraction amount, by making the toner density control target value Vtref less by 0.1 V the toner density is made greater. Accordingly, the toner attraction amount is made greater and is made close to the target attraction amount.

Figure 26:
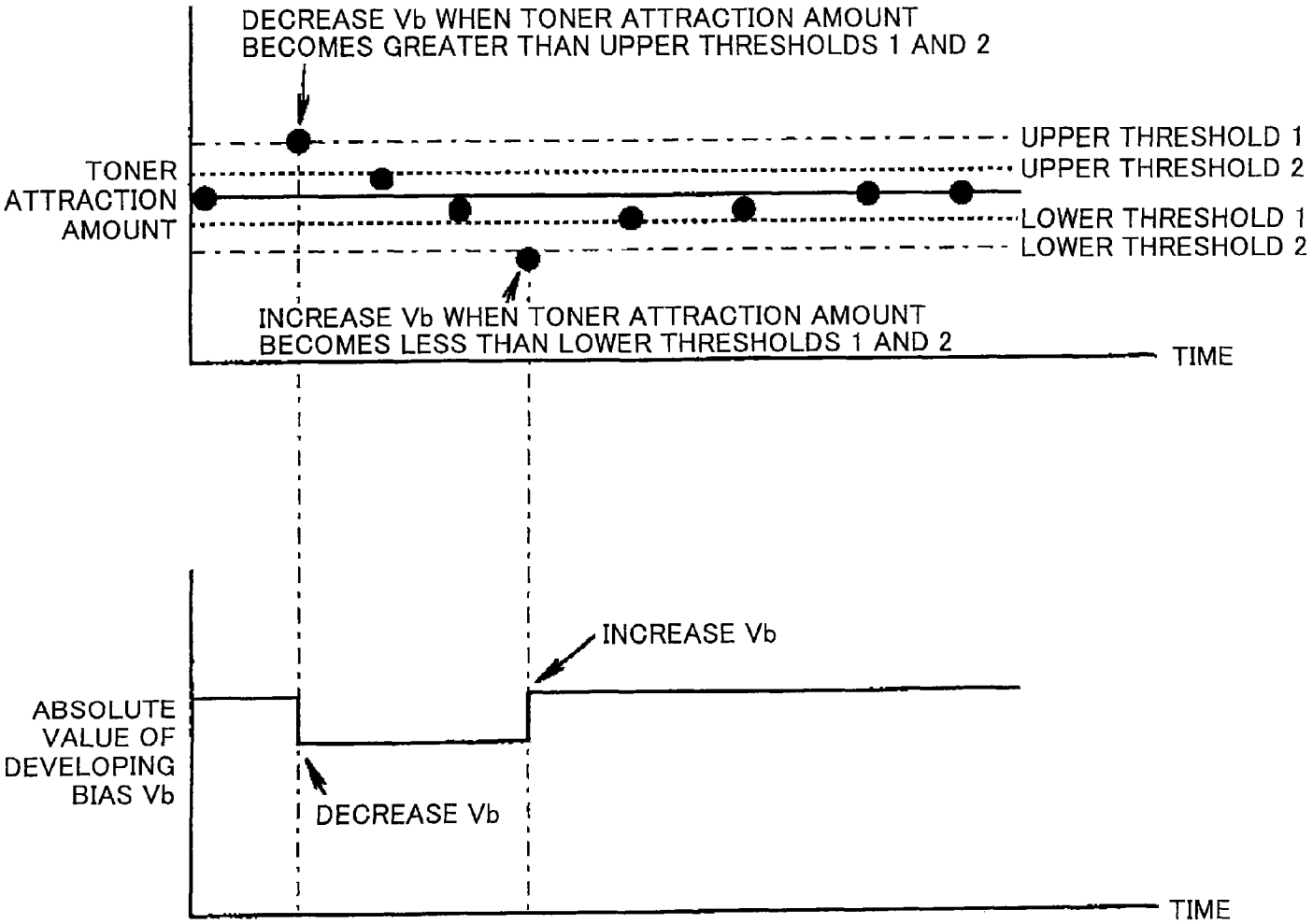
FIG. 26 is a pattern diagram for explaining an example of a relation between the result of detecting the toner attraction amount and a correction amount of a developing bias Vb according to the present embodiment.

Meanwhile, though an example of correcting the toner density control target value Vtref as a control parameter in the simple correction processing for the target value is explained instead of the toner density control target value Vtref other control parameter may be corrected. For example, the developing bias may be corrected. In the case of correcting the developing bias the following correction may be performed. That is, as shown in FIG. 26 in the case where the toner attraction amount of the segmented region is greater than the target attraction amount the developing bias Vb is corrected to a smaller value. On the other hand, in the case where the toner attraction amount of the segmented region is less than the target attraction amount the developing bias Vb is corrected to a greater value. As shown in FIG. 26 for the toner attraction amount two upper threshold values including an upper threshold value 1 and an upper threshold value 2 which is greater than the upper threshold value 1 and two lower threshold values including an lower threshold value 1 and an lower threshold value 2 which is less than the lower threshold value 1 may be provided. Then, as shown in FIG. 27 a correction amount for the developing bias Vb is preferably determined based on in which range the toner attraction amount is for the thresholds.

Specifically, in the case where the toner attraction amount of the segmented region exceeds the upper threshold value 2, i.e., it is substantially greater than the target attraction amount, by making an absolute value of the developing bias Vb lower by 4 V the developing potential is made lower by 4 V. Accordingly, the toner attraction amount is made lower and is made closer to the target attraction amount. Moreover, in the case where the toner attraction amount of the segmented region is less than the upper threshold value 2 and greater than or equal to the upper threshold value 1, i.e., it is slightly greater than the target attraction amount, by making the absolute value of the developing bias Vb lower by 2 V the developing potential is made lower by 2 V. Accordingly, the toner attraction amount is made lower and is made closer to the target attraction amount. Moreover, in the case where the toner attraction amount of the segmented region is greater than the lower threshold 1 and less than or equal to the upper threshold value 1, since the target toner attraction amount is basically obtained the correction for the developing bias Vb is not performed. Moreover, in the case where the toner attraction amount of the segmented region is less than the lower threshold value 1 and greater than or equal to the lower threshold value 2, i.e., it is slightly less than the target attraction amount, by making the absolute value of the developing bias Vb greater by 2 V the developing potential is made greater by 2 V. Accordingly, the toner attraction amount is made greater and is made close to the target attraction amount. Moreover, in the case where the toner attraction amount of the segmented region is less than the lower threshold value 2, i.e., it is substantially less than the target attraction amount, by making the absolute value of the developing bias Vb greater by 4 V the developing potential is made greater by 4 V. Accordingly, the toner attraction amount is made greater and is made close to the target attraction amount.

Moreover, as the control parameter a laser light quantity of the optical writing unit 20 may be corrected. In the case where the toner attraction amount of the segmented region is greater than the target attraction amount the laser light quantity is made smaller. On the other hand, in the case where the toner attraction amount of the segmented region is less than the target attraction amount the laser light quantity is made greater. In this way, by correcting the laser light quantity the toner attraction amount can be made closer to the target attraction amount.

Moreover, in the printer according to the present embodiment, by performing the simple correction processing for the target value an interval for conducting the process control processing in the successive print mode is made longer and a down time of the apparatus is made shorter. Specifically, the process control processing is basically conducted every time an accumulated number of printed sheets increases by 100. For example, assume that an increase in the accumulated number of printed sheets right before a successive print mode is conducted from the previous process control processing (in the following denoted "increased number of sheets") is 80. Then, assume that the successive print mode in which images are output on 500 recording sheets successively starts. In this case, when images are output on 20 recording sheets from the start of the successive print mode the "increased number of sheets" is 100. Therefore, basically at this stage the successive print is temporarily halted and the process control processing is conducted. A user waits in the meantime.

On the other hand, in the printer according to the present embodiment the simple correction processing for the target value is conducted in each print. Then, in the simple correction processing for the target value it is determined whether there is a segmented region suitable for use for detecting a toner attraction amount. In the case where a suitable segmented region exists, the toner density control target value Vtref is corrected and the toner attraction amount can be made closer to the target attraction amount. Accordingly, in the case where in the successive print mode the toner density control target value Vtref can be corrected in the simple correction processing for the target value, the "increased number of sheets" is reset to zero. For example, assume that the successive print mode starts from the state where the "increased number of sheets" is 80 and afterwards at the tenth print the toner density control target value Vtref can be corrected. Then, at this time the "increased number of sheets" is reset to zero. Accordingly, the interval for conducting the process control processing is made longer and the down time of the apparatus can be made shorter.

Next, a printer according to an example which is the printer according to the embodiment to which the characteristic configuration is added will be explained. Meanwhile, unless particularly stated the configuration of the printer according to the example is the same as that in the embodiment.

First Example

Figure 28:
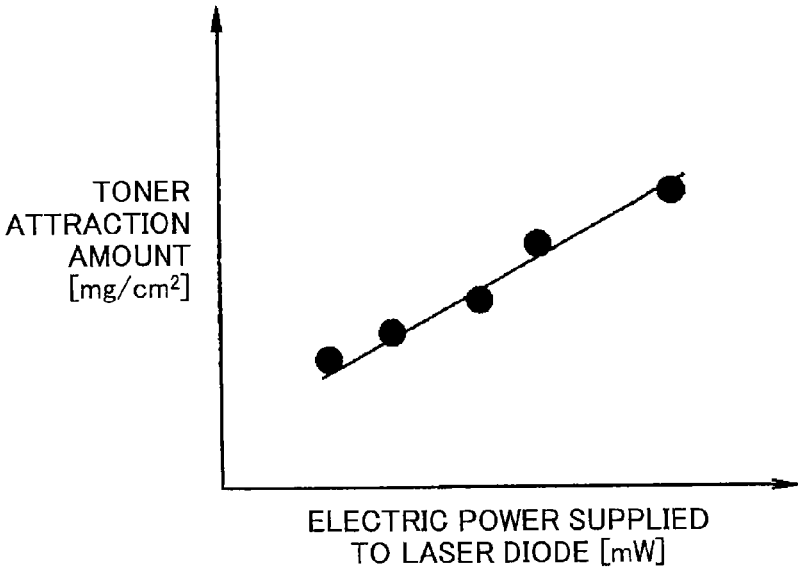
FIG. 28 is a diagram illustrating an example of a relation between electric power supplied to a laser diode in an optical writing unit and a toner attraction amount in a halftone part of an image according to the present embodiment.

By conducting the process control processing described above a target attraction amount (target image density) can be obtained in a solid image part. However, it does not necessarily obtain a target attraction amount for halftone in a halftone part. The toner attraction amount for halftone can be changed by adjusting LD power (electric power supplied to a laser diode) in the optical writing unit 20. FIG. 28 is a diagram illustrating a relation between the LD power in the optical writing unit 20 (electric power supplied to the Laser Diode) and a toner attraction amount in a halftone part of an image. As shown in FIG. 28, as the LD power increases the toner attraction amount increases. The reason is as follows. That is, as the LD power increases the laser light amount also increases, a potential decay rate of an electrostatic latent image becomes greater and a latent image potential becomes lower. Then, the developing potential becomes greater and the toner attraction amount becomes greater.

Then, in the printer according to the present example a halftone control processing is conducted right after the process control processing and the LD power is corrected so that the target attraction amount for halftone can be obtained in the halftone part of the image.

Figure 29:
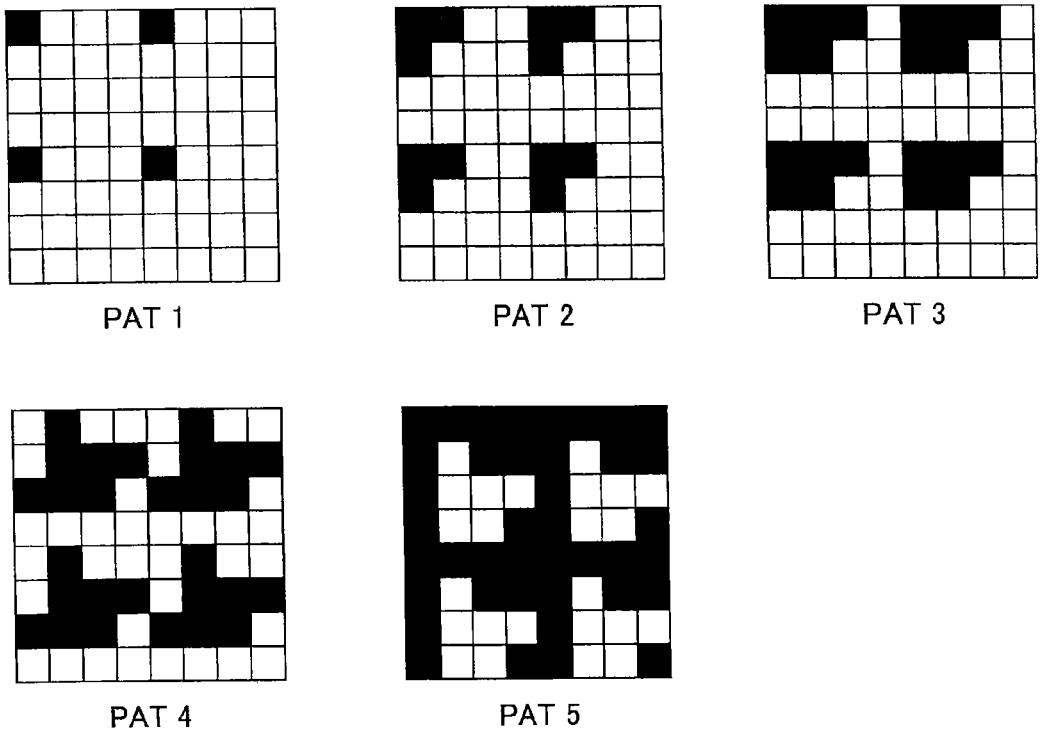
FIG. 29 is pattern diagram illustrating an example of respective gradation matrices of a dot dispersion type dither matrix according to the present embodiment.

For the method of expressing a halftone in the present example a method of expressing a halftone with area gradation including five levels of PAT1 to PAT5 as shown by dot dispersion type dither matrices in FIG. 29 is employed. When the LD power deviates from an appropriate value in halftones of the five levels target attraction amounts corresponding to the respective halftones cannot be obtained.

In the halftone control processing for each of the colors the following control is conducted individually. That is, at first a halftone pattern including five halftone test toner images expressed by the halftones of the file levels respectively is formed on the intermediate transfer belt 41. Then, toner attraction amounts for the halftone test toner images respectively are calculated based on a result of detecting the halftone test toner images by the optical sensor 150. This calculation is performed in the same way as the calculation of the toner attraction amount in the process control processing.

Figure 30:
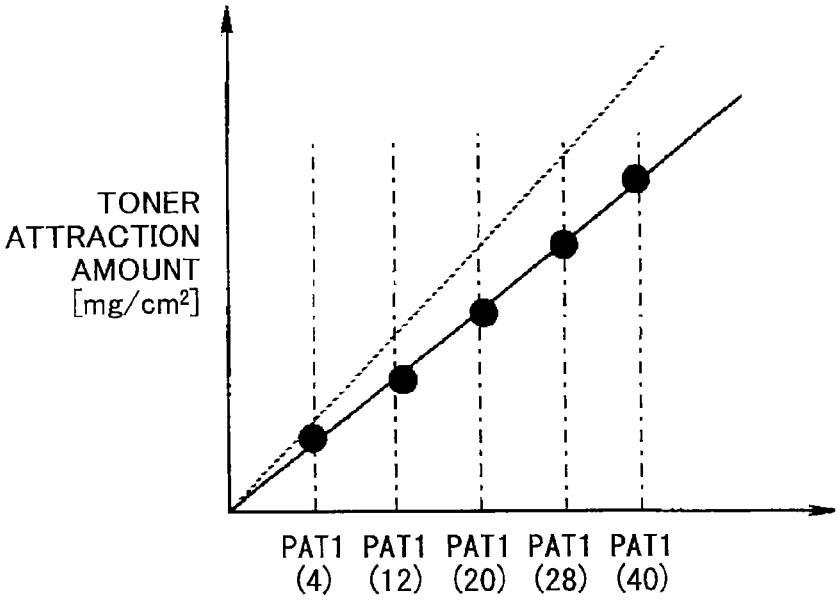
FIG. 30 is a diagram illustrating an example of a relation between the toner attraction amount and a number of recording dots in the dither matrix of a halftone test toner image according to the present embodiment.

Next, as shown in FIG. 30 an approximated line indicating a relation between the respective toner attraction amounts and a recording dot numbers of the dither matrices in the halftone test toner images in the two dimensional coordinate system is obtained. The solid line in FIG. 30 is the approximated line. The LED power that can obtain the target attraction amount in the respective halftone test toner images is calculated based on an angle between the approximated line and a line representing the target attraction amount of each of the halftone test toner images (dotted line in FIG. 30). And, the LD power is corrected to the same value as the result of calculation.

According to the halftone control processing described above also in the halftone part of the image a target attraction amount (target image density) can be obtained. However, when in the successive print mode in order to conduct the halftone control processing a successive print job is temporarily halted, a wait time for the user may be extended.

Moreover, assume that processing is conducted in which in order to avoid the above extension only one halftone test toner image is formed in the interspace corresponding region on the intermediate transfer belt 41 in the successive print mode and the LD power is corrected based on the toner attraction amount for it. Since even by referring to the toner attraction amount for one halftone test toner image an appropriate value of the correction amount of the LD power can be obtained with certain accuracy, by the processing in this way a substantial inadequacy in the halftone toner attraction amount can be suppressed. However, by forming halftone test toner images in the interspace corresponding region a consumption of toner which the user does not intend occurs and a running cost increases.

Then, in the printer according to the first example a simple correction processing for the LD power is conducted as follows. That is, the determination unit 206 for the respective segmented regions of C1 to C10 determines whether it is the segmented region as follows based on the image information acquired from the write data memory unit 204. That is, it is determined whether an entire region of the segmented region is expressed by the area gradation of PAT3 in the dither matrix (See FIG. 29). Then, in the case where it is expressed by PAT3 it is determined for the segmented region that it is suitable for use for detecting a halftone toner attraction amount. On the other hand, in the case where it is not expressed by PAT3, it is determined for the segmented region that it is not suitable for use for detecting a halftone toner attraction amount.

The above-described determination is performed in the order of the segmented region C1, segmented region C2, . . . , the segmented region C10. In the case where the segmented region suitable for use for detecting is found during the above process further determination is not performed.

Figure 31:
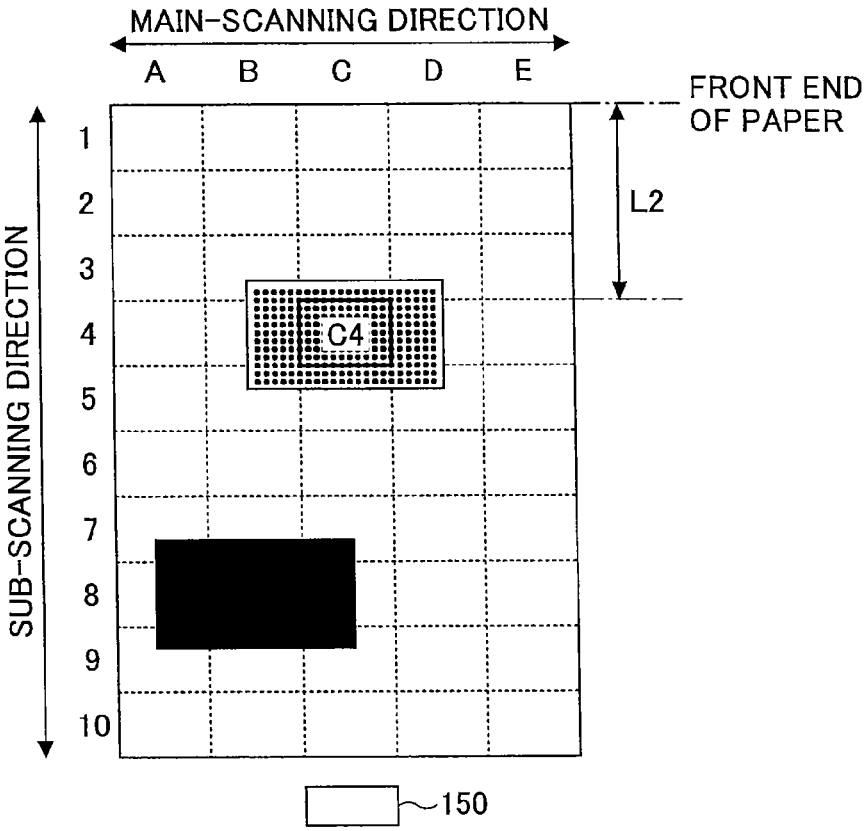
FIG. 31 is a pattern diagram for explaining an example of a positional relationship among the segmented region, an image and the optical sensor according to the present embodiment.

FIG. 31 is a pattern diagram for explaining a positional relationship among the segmented region, an image and the optical sensor 150. As shown in FIG. 31 on the paper an image part in which a halftone is expressed with PAT3 (halftone image part) and a solid image part are formed. Though the halftone image part in which the halftone is expressed with PAT3 is formed partially in the segmented region C3 but is not formed in the entire region in the segmented region C3. Therefore, the determination unit 206 determines that the segmented region C3 is not suitable for use for detecting the halftone toner attraction amount. On the other hand, the halftone image part is formed in the entire region of the segmented region C4. Therefore, the determination unit 206 determines that the segmented region C4 is suitable for use for detecting the halftone toner attraction amount. The determination unit 206 ends the process of determination at this stage and does not perform the determination further for the segmented regions C5 to C10. Then, the positional information on the segmented region C4 is sent to the control device 100. The method of sending the positional information is the same as in the simple correction processing for the target value and the explanation will be omitted. However, in the simple correction processing for the target value the distance L1 is sent as the positional information, but in the simple correction processing for the LD power the distance L2 is sent as the positional information.

The control device 100 upon receiving the information of the distance L2 which is the positional information of the halftone from the determination unit 206 calculates the "region entry time". Then, at timing when the "region entry time" elapses from the reception of the writing start signal a sampling is performed for outputs from the optical sensor 150. Then, based on the result of the sampling a toner attraction amount of the halftone image part formed in the segmented region C4 is calculated and the LD power is corrected based on the result of the calculation.

In the configuration described above a correction amount for the LD parameter as a control parameter is calculated based on the result of detecting the toner attraction amount of the region which is suitable for use for detecting a halftone toner attraction amount in a toner image formed based on an instruction from a user. Then, without forming a dedicated halftone test toner image for detecting a toner attraction amount in the interspace corresponding region on the intermediate transfer belt 41, the LD power can be corrected appropriately. Accordingly, an inadequacy in the image density in the halftone part due to a fluctuation of an environment and a charge quantity of toner can be suppressed with a lower cost than that of the related art.

Meanwhile, instead of correcting the LD power as the control parameter, writing dot numbers in the dither matrix may be corrected. In the case where the toner attraction amount of the halftone image part is greater than the target attraction amount the writing dot numbers may be made smaller. On the other hand, in the case where the toner attraction amount of the halftone image part is less than the target attraction amount the writing dot numbers may be made greater.

Moreover, in the printer according to the present example, by performing the simple correction processing for the LD power an interval for conducting the halftone control processing in the successive print mode is made longer and a down time of the apparatus is made shorter. Specifically, the halftone control processing is basically conducted every time an accumulated number of printed sheets increases by 100. For example, assume that an increase in the accumulated number of printed sheets right before a successive print mode is conducted from the previous halftone control processing (in the following denoted "increased number of sheets for halftone") is 80. Then, assume that the successive print mode in which images are output on 500 recording sheets successively starts. In this case, when images are output on 20 recording sheets from the start of the successive print mode the "increased number of sheets for halftime" is 100. Therefore, basically at this stage the successive print is temporality halted and the halftone control processing is conducted. A user waits in the meantime.

On the other hand, in the printer according to the present example the simple correction processing for the LD power is conducted in each print. Then, in the simple correction processing for the LD power it is determined whether there is a segmented region suitable for use for detecting a halftone toner attraction amount. In the case where a suitable segmented region exists, the LD power is corrected and the toner attraction amount in the halftone part can be made closer to the target attraction amount. Accordingly, in the case where in the successive print mode the LD power can be corrected in the simple correction processing for the LD power, the "increased number of sheets for halftone" is reset to zero. For example, assume that the successive print mode starts from the state where the "increased number of sheets for halftone" is 80 and afterwards at the tenth print the LD power can be corrected. Then, at this time the "increased number of sheets for halftone" is reset to zero. Accordingly, the interval for conducting the process control processing is made longer and the down time of the apparatus can be made shorter.

Second Example

Since when an environment is fluctuated a potential decay characteristic of an exposure unit of the photoreceptor changes, a radius of a dot written by an exposure is altered slightly. Accordingly, a line width of a line image on which plural dots are arranged vertically and horizontally may be altered.

In the printer according to the present example, line width correction processing is periodically conducted and the LD power is corrected so as to obtain a target line width.

In the line width correction processing for each of the colors the following control is performed individually. That is, at first a line image in which plural dots are arranged in the main-scanning direction is formed on the intermediate transfer belt 41. Then, a line width of the line image is calculated based on the result of detecting the line image extending in the main-scanning direction by the optical sensor 150.

Figure 32:
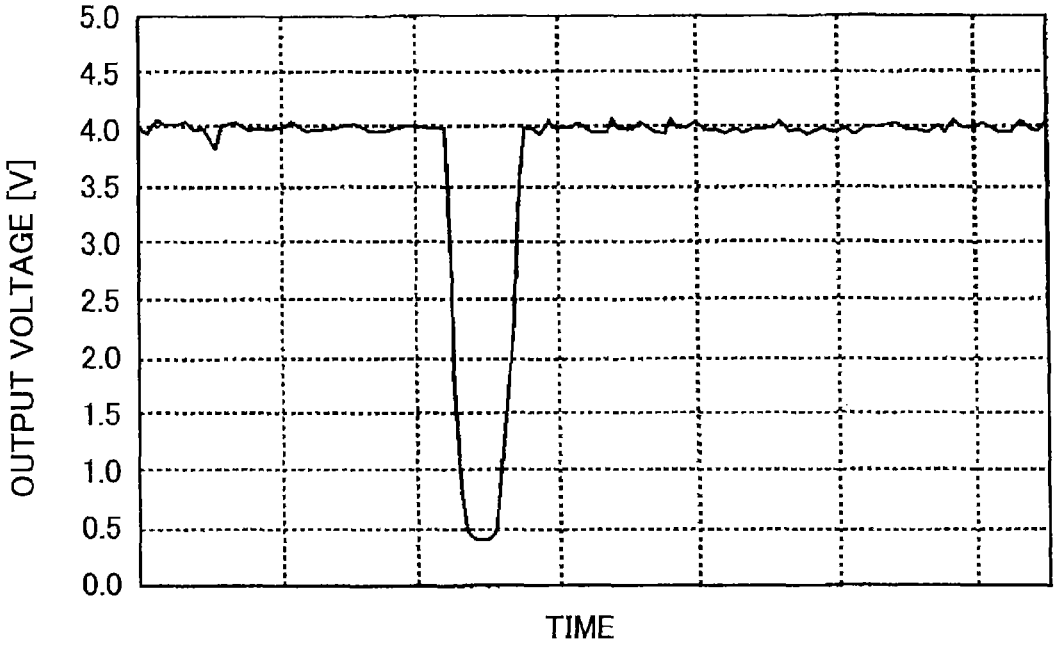
FIG. 32 is a diagram illustrating an example of an output voltage from a regular reflection reception unit of the optical sensor in the case where a K line image is a detection object according to the present embodiment.

FIG. 32 is a diagram illustrating an output voltage from the regular reflection reception unit 150*b* of the optical sensor 150 in the case where a K line image is a detection object. A line width of the K line image is calculated based on a change in the output voltage from the regular reflection reception unit 150*b*. Specifically, since when the background part on the intermediate transfer belt 41 passes the position opposed to the regular reflection reception unit 150*b* a lot of regular reflection light is obtained on the surface of the belt, the output voltage from the regular reflection reception unit 150*b* is stable around 4.0 V as shown in FIG. 32. On the other hand, on the surface of the K line image formed on the surface of the belt regular reflection light is hardly obtained. For this reason, when the K line image enters the position opposed to the regular reflection reception unit 150*b* the output voltage from the regular reflection reception unit 150*b* rapidly decreases to around 0.5 V as shown in FIG. 32. Within a time from a fall to a rise of the output voltage the K line image passes the position opposing the regular reflection reception unit 150*b* and the time is proportional to the line width of the K line image. The control device 100 calculates the line width of the K line image based on the time.

Figure 33:
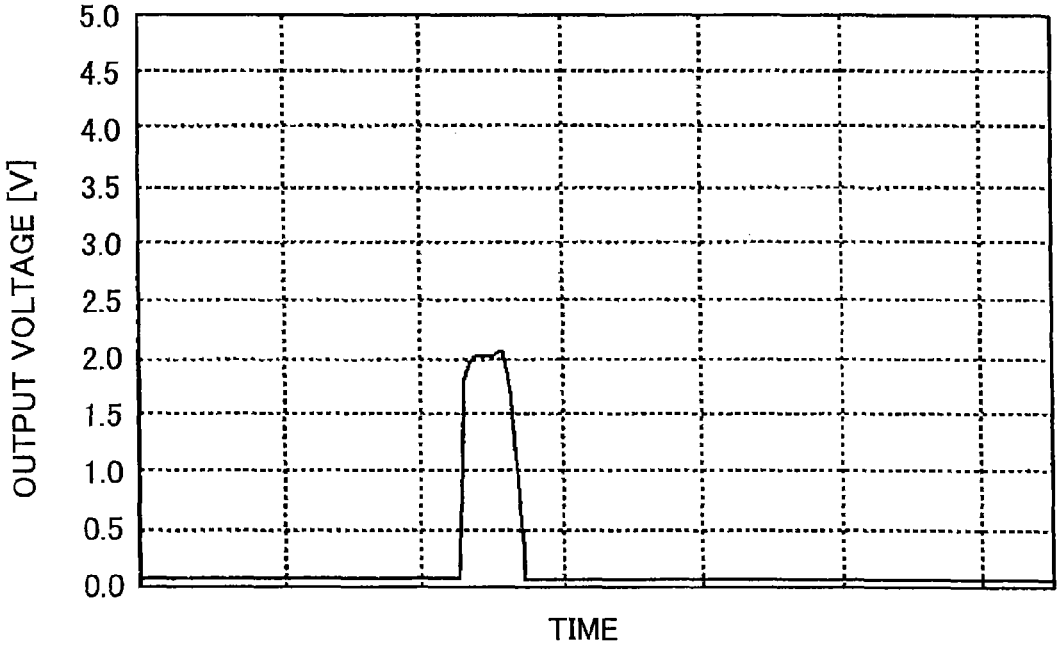
FIG. 33 is a diagram illustrating an example of an output voltage from a diffuse reflection reception unit of the optical sensor in the case where a line image of any of the Y, M and C toners is a detection object according to the present embodiment.

FIG. 33 is a diagram illustrating an output voltage from the diffuse reflection reception unit 150*c* of the optical sensor 150 in the case where a line image of any of the Y, M and C toners is a detection object. A line width of the Y, M, C line image is calculated based on a change in the output voltage from the diffuse reflection reception unit 150*c*. Specifically, since when the background part on the intermediate transfer belt 41 passes the position opposing the diffuse reflection reception unit 150*c* diffuse reflection light is hardly obtained on the surface of the belt, the output voltage from the diffuse reflection reception unit 150*c* is stable less than 0.1 V as shown in FIG. 32. On the other hand, on the surface of the Y, M, C line image formed on the surface of the belt a fair amount of diffuse reflection light is obtained. For this reason, when the Y, M, C line image enters the position opposing the diffuse reflection reception unit 150*c* the output voltage from the diffuse reflection reception unit 150*c* rapidly increases to around 2.0 V as shown in FIG. 33. Within a time from a rise to a fall of the output voltage the Y, M, C line image passes the position opposing the diffuse reflection reception unit 150*c* and the time is proportional to the line width of the Y, M, C line image. The control device 100 calculates the line width of the Y, M, C line image based on the time.

The greater the LD power is, the greater the line width is. The control device 100 upon calculating the line width of the line image compares the result of calculation with the target line width. Then, by correcting the LD power by an amount according to a difference between them the line width is made closer to, the target line width. For example, the line width correction processing described above is conducted every time print processing for 100 sheets is performed. In the successive print mode four line images of Y, M, C and K are formed in the interspace corresponding region on the intermediate transfer belt 41 and the optical sensor 150 detects the line images. Accordingly, it is not necessary to halt the successive print operation temporarily due to the line width correction processing.

However, by forming the line images in the interspace corresponding region a consumption of toner which the user does not intend occurs and a running cost increases.

In the printer according to the second example simple correction processing for a line width is conducted as follows. That is, the determination unit 206 for the respective segmented regions of C1 to C10 determines whether it is the segmented region as follows based on the image information acquired from the write data memory unit 204. That is, it is determined whether any of the Y, M, C and K line images exists in the segmented region. Then, in the case where any of the line images exists it is determined for the segmented region that it is suitable for use for detecting a line image. On the other hand, in the case where none of the line images exist it is determined for the segmented region that it is not suitable for use for detecting a line image.

The above-described determination is performed in the order of the segmented region C1, segmented region C2, . . . , the segmented region C10. The determination continues to the final segmented region C10 unless the line images of all the colors become detectable. For example, even if it is determined for the segmented region C1 that it is suitable for use for detecting a Y line image since M, C, K line images are not detectable, the determination continues for the segmented region C2 and further.

Figure 34:
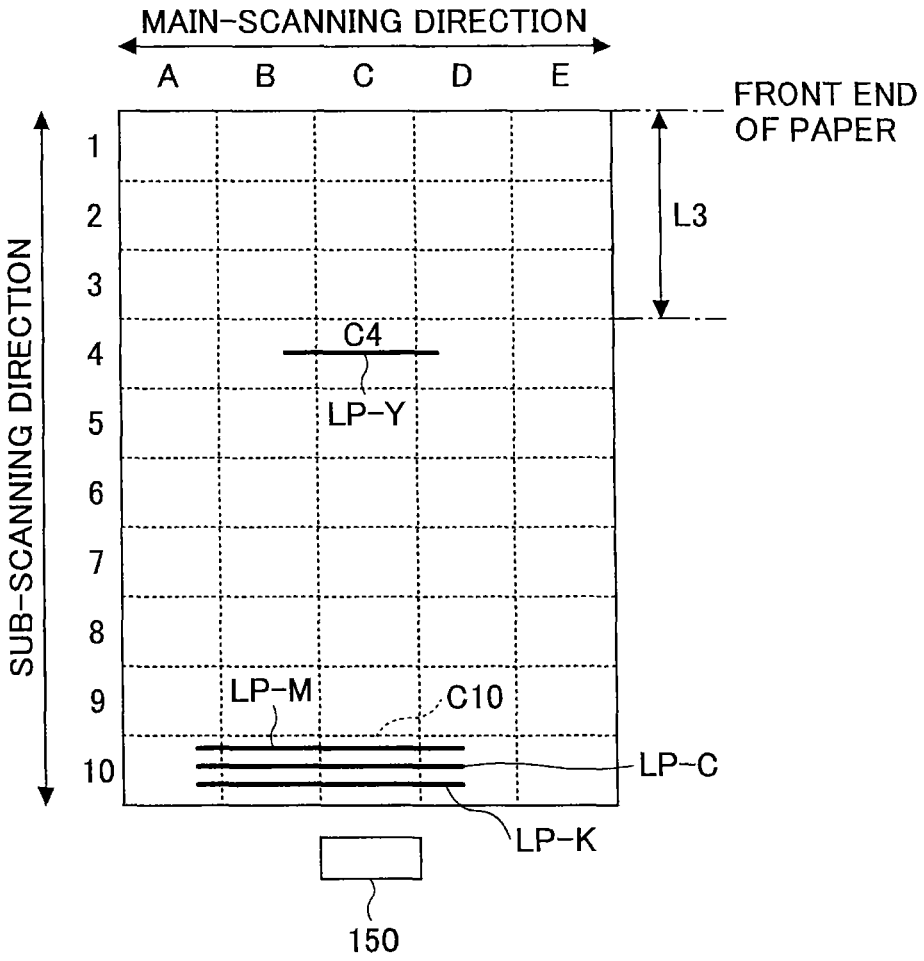
FIG. 34 is a pattern diagram for explaining an example of a positional relationship among the segmented region, a line image and the optical sensor according to the present embodiment.

FIG. 34 is a pattern diagram for explaining a positional relationship among the segmented region, the line image and the optical sensor 150. As shown in FIG. 34, a Y line image LP-Y, an M line image LP-M, a C line image LP-C and a K line image LP-K are formed. The Y line image is formed on the segmented region C4. Therefore, the determination unit 206 determines that the segmented region C4 is suitable for use for detecting a Y line image LP-Y. Then, color information of the line image (Y in this example) and a distance L3 from the front end of the paper to the segmented region C4 are sent to the control device 100. Moreover, the M line image LP-M, the C line image LP-C and the K line image LP-K are arranged in the sub-scanning direction in the segmented region C10. Therefore, the determination unit 206 determines that the segmented region C10 is suitable for use for detecting these three line images. Then, color information of the line image (M, C and K in this example) and a distance from the end of the paper to the segmented region C10 are sent to the control device 100. In this case the color information is sent in the order of the sub-scanning direction. In this example shown in FIG. 34 it is the order of M, C and K.

The control device 100 upon receiving the color information or the information of the distance L3 calculates the "region entry time". Then, at timing when the "region entry time" elapses from the reception of the writing start signal a sampling is performed for outputs from the optical sensor 150. Then, based on the result of the sampling a line width of the line images formed on the segmented region C4 or the segmented region C10 and the LD power is corrected based on the result of the calculation.

In the configuration described above a correction amount for the LD parameter as a control parameter is calculated based on the result of detecting the line image in the region which is suitable for use for detecting a line image in a toner image formed based on an instruction from a user. Then, without forming a dedicated line image for detecting a line width in the interspace corresponding region on the intermediate transfer belt 41 the LD power can be corrected appropriately. Accordingly, an inadequacy in the image density in the halftone part due to a fluctuation of an environment and a charge quantity of toner can be suppressed with a lower cost than that of the related art.

Meanwhile, in the printer according to the present example, in the case of conducting the simple correction processing for the line width, the toner consumption amount can be suppressed omitting the line width correction processing by that amount. Specifically, the line width correction processing is conducted every time an accumulated number of printed sheets increases by 100. Assume that during an increased number of the accumulated number of printed sheets increases from 1 to 100, for example, the LD power can be corrected by the simple correction processing for the line width for the three colors of Y, M and C. In this case, in the line width correction processing only a K line image is formed and only the LD power for K is corrected.

Third Example

A printer according to a third example when a print (page printing) where there is not a segmented region suitable for use for detecting a toner attraction amount in a matrix of an image region is performed continuously by a predetermined number of times conducts the following processing. That is, right after the simple correction processing for the target value a process control processing as a second control parameter correction processing is performed.

Figure 35:
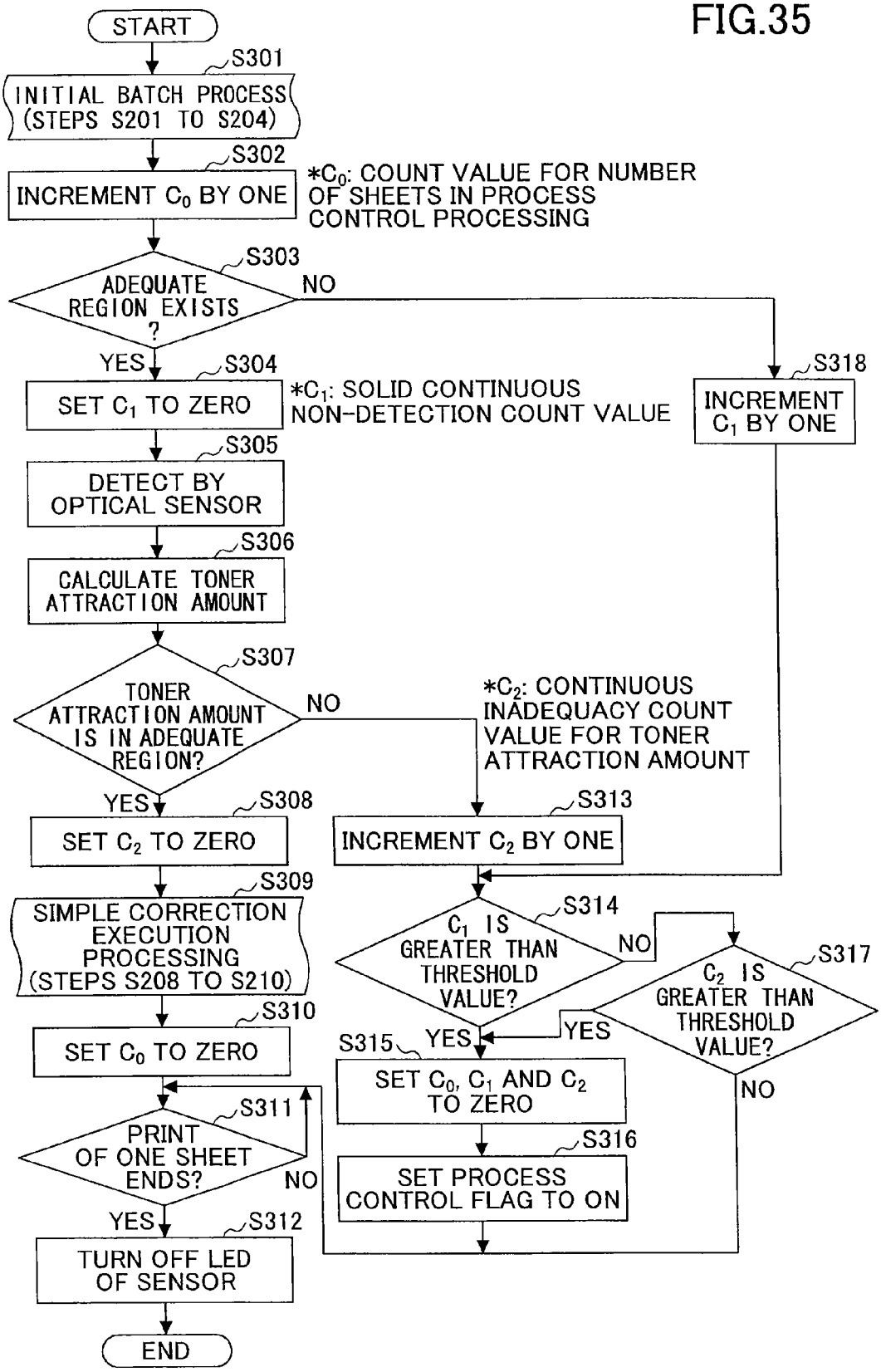
FIG. 35 is a flowchart illustrating an example of a process flow of the simple correction processing for a target value executed in the printer according to the third example.

FIG. 35 is a flowchart illustrating a process flow of the simple correction processing for a target value executed in the printer according to the third embodiment. The control unit of the printer at first conducts an initial batch processing (step S301) when the simple correction processing for the target value starts. The initial batch processing is a processing that performs the processes of steps S201 to S204 in the simple correction processing for the target value in the printer according to the embodiment. That is, it performs sequentially processing of turning on the LED, acquiring the print condition, acquiring information on the recording pixel number for each segmented region (image information) and calculating recording pixel density for each segmented region.

Next, the control unit updates a count value for number of sheets in process control processing $C_0$ by incrementing by one (step S302). The count value for number of sheets in process control processing $C_0$ is a variable that is counted up every time one sheet is printed in order to grasp an arrival of timing of conducting the process control processing. The control unit determines whether each of the segmented regions is suitable for use for detecting a toner attraction amount based on the recording pixel density (step S303) after the count up. Then, in the case where there is a segmented region suitable for a detection object (step S303: YES) a solid continuous non-detection count value $C_1$ is reset to zero (step S304). The solid continuous non-detection count value $C_1$ is to count a number of consecutive determinations in the case where the control unit determines consecutively that there is not a segmented region suitable for a detection object for the respective prints in the continuous printing. When the control unit resets the solid continuous non-detection count value $C_1$ to zero at step S304, after detecting by the optical sensor the segmented region which is determined to be suitable for use for detecting a toner attraction amount (step S305) the control unit calculates the toner attraction amount based on the result of detection (step S306). Then, it is determined whether the result of calculation is within an adequate range (step S307).

On the other hand, in the case where there is not a segmented region suitable for a detection object (step S303: NO), after updating the solid continuous non-detection count value $C_1$ by incrementing by one (step S318) the process flow proceeds to step S314 which will be described below.

Moreover, in the case where the control unit determines that the toner attraction amount is within the adequate range (step S307: YES), after resetting a continuous inadequacy count value for toner attraction amount $C_2$ to zero (step S308) the control unit conducts a simple correction execution processing (step S309). The continuous inadequacy count value for toner attraction amount $C_2$ is to count a number of consecutive determinations in the case where the control unit determines consecutively that the toner attraction amount is not in the adequate range for the respective prints in the continuous printing. Moreover, the simple correction execution processing (step S309) is a processing that performs the processes of steps S208 to S210 in the simple correction processing for the target value in the printer according to the embodiment. That is, it performs sequentially processing of calculating a correction amount for the toner density control target value Vtref based on the toner attraction amount, storing the correction amount and correcting with the correction amount. Then, after resetting the count value for number of sheets in process control processing $C_0$ (step S310), it waits for an end of a print of one sheet (step S311), and right after that the LED of the optical sensor is turned off (step S312) so that the processing flow ends.

On the other hand, in the case where the control unit determines that the toner attraction amount is not within the adequate range (step S307: NO), the following processing flow is conducted. That is, after updating the continuous inadequacy count value for toner attraction amount $C_2$ by incrementing by one (step S313) it is determined whether the solid continuous non-detection count value $C_1$ exceeds a predetermined threshold value (step S314). Then, in the case where it exceeds the predetermined threshold value (step S314: YES), after resetting the count value for number of sheets in process control processing $C_0$, the solid continuous non-detection count value $C_1$ and the continuous inadequacy count value for toner attraction amount $C_2$ to zero respectively (step S315) a process control flag is set to ON (step S316). Afterwards, through the processes of steps S311 and S312 the processing flow ends. When the simple correction processing for the target value is finished in this way, since the process control flag is on, the continuous printing job is temporarily halted and the process control as above is conducted.

Moreover, in the case where it is determined that the solid continuous non-detection count value $C_1$ does not exceed the predetermined threshold value (step S314: NO) it is determined whether the continuous inadequacy count value for toner attraction amount $C_2$ exceeds the predetermined threshold (step S317). In the case where it exceeds the predetermined threshold (step S317: YES), after executing the processes of steps S315, S316, S311 and S312 the processing flow ends in the same way as the case where it is determined that the solid continuous non-detection count value $C_1$ exceeds the predetermined threshold. On the other hand, in the case where it is determined that the continuous inadequacy count value for toner attraction amount $C_2$ does not exceed the predetermined threshold (step S317: NO), after executing the processes of steps S311 and S312 the processing flow ends.

In the simple correction processing for the target value described above in the case where it determines consecutively that a print does not include a segmented region suitable for use for detecting a toner attraction amount in a matrix of an image region by more than the predetermined number of times, the result of determination at step S314 is "YES". Then, since the process control flag is set to ON at step S316, right after the simple correction processing for the target value the process control is conducted. Assume that in the configuration as above since it is determined consecutively that a print does not output a segmented region suitable for use for detecting a toner attraction amount by more than the predetermined number of times, a number of prints in which the simple correction for the toner density control target value Vtref cannot be performed exceeds a predetermined threshold. In this case since the toner density control target value Vtref is likely to deviate significantly from an appropriate value, the process control flag is set to ON at step S316 as above. Then, the image density can be controlled appropriately by temporarily halting the continuous printing job and conducting the process control processing right after the simple correction processing for the target value.

Moreover, in the printer according to the present example assume that it is determined at step S303 that it is determined to be suitable for use for detection and it is determined consecutively that a toner attraction amount is not within the adequate range at step S307 by more than a predetermined number of times. In this case the process control flag is set to ON at step S316 and the process control processing is conducted right after the simple correction processing for the target value. In this configuration as above in the case where the toner attraction amount deviates from the adequate range since the image formation condition such as the developing bias is different from an adequate value due to an environmental fluctuation or the like, the image formation condition is appropriately corrected by detecting it and conducting the process control processing. Accordingly, stable image density can be realized over a long period.

Moreover, in the printer according to the present example, assume that it is determined at step S303 that it is determined to be suitable for use for detection and it is determined that a toner attraction amount is within the adequate range at step S307. In this case the count value for number of sheets in process control processing $C_0$ is reset to zero at step S310 and timing for conducting the next process control processing is extended rather than performed as scheduled. In the configuration as above in the case where the image formation condition is an adequate value and the toner attraction amount is within the adequate range, the timing for conducting the process control processing is extended rather than performed as scheduled. Accordingly, an occurrence of down time in the apparatus due to excessive process control processing can be avoided.

The embodiments and the examples explained as above are examples, and the present invention has a particular effect for each of the following aspects.

[Aspect A]

An aspect A is an image forming apparatus including an image information acquisition unit that acquires image information (for example the image data input unit 201), a toner image formation unit (for example the optical writing unit 20, image formation units 1Y, 1M, 1C and 1K, the transferring unit 40 or the like) that forms a toner image on a surface of an image carrier (for example the intermediate transfer belt 41) based on the image information acquired by the image information acquisition unit, an image density detection unit (for example the optical sensor 150) that detects image density of the toner image formed on the surface of the image carrier, a control unit (for example the control device 100 and the writing control unit 202) that performs a parameter correction processing for correcting a control parameter in the toner image formation unit so as to obtain a desired image quality based on a detection result by the image density detection unit. The aspect A has a feature that the control unit is configured to perform a determination processing for determining whether a predetermined region of the toner image formed based on the image information is suitable for use for detecting the image density in the parameter correction processing, and in the case where it is determined that the predetermined region is suitable for use for detection in the determination processing, perform a processing for correcting the control parameter based on a result of detecting the image density of the predetermined region by the image density detection unit as the parameter correction processing.

[Aspect B]

An aspect B has a feature that in the aspect A the control unit is configured to determine that the predetermined region is suitable for use for detection in the case where the predetermined region is a solid image part in the determination processing and perform a processing for correcting the control parameter so as to obtain desired image density in the solid image part in the parameter correction processing.

[Aspect C]

An aspect C has a feature that in the aspect A or B the control unit is configured to determine that the predetermined region is suitable for use for detection in the case where the predetermined region is a halftone image part in the determination processing and perform a processing for correcting the control parameter so as to obtain desired image density in the halftone image part in the parameter correction processing.

[Aspect D]

An aspect D has a feature that in any one of the aspects A to C the control unit is configured to determine that the predetermined region is suitable for use for detection in the case where the predetermined region is a line image part in the determination processing and perform a processing for correcting the control parameter so as to obtain a line image with a predetermined thickness in the parameter correction processing.

[Aspect E]

An aspect E has a feature that in the aspect B the control unit is configured to perform a processing for determining that the predetermined region is a solid image part in the case where a recording pixel density in the predetermined region is greater than or equal to a predetermined threshold in the determination processing.

[Aspect F]

An aspect F has a feature that in the aspect C the control unit is configured to perform a processing for determining that the predetermined region is suitable for use for detection in the case where all dots in the predetermined region is a predetermined gradation expressed by a dot dispersion type dither matrix (for example PAT3) in the determination processing.

[Aspect G]

An aspect G has a feature that in the aspect B, C, E or F the control unit is configured to perform the control parameter correction processing as a first control parameter correction processing (for example the simple correction processing for the target value or the simple correction processing for the LD power) and perform as a second control parameter correction processing (for example the process control processing, or the halftone control processing) for correcting the control parameter so as to obtain desired image density in a solid image part or in a halftone image part based on a result of forming a pattern image (for example the gradation pattern image) including plural toner images image densities of which are different from each other on the surface of the image carrier and detecting respectively image densities of the plural toner images by the image density detection unit.

[Aspect H]

An aspect H has a feature that in the aspect G the control unit is configured to perform the second control parameter correction processing in the case where it determines consecutively that the predetermined region is not suitable for use for detection by a predetermined number of times in the determination processing.

[Aspect I]

An aspect I has a feature that in the aspect G or H the control unit is configured to perform the second control parameter correction processing in the case where it determines consecutively that the predetermined region is suitable for use for detection in the determination processing and that a detection result of the image density is not within a predetermined adequate range by a predetermined number of times.

[Aspect J]

An aspect J has a feature that in any one of the aspects G to I the control unit is configured to perform a processing for extending timing for conducting the next second control parameter correction processing than scheduled in the case where it determines that the predetermined region is suitable for use for detection in the determination processing and that a detection result of the image density is within a predetermined adequate range.

[Aspect K]

An aspect K has a feature that in any one of the aspects G to J the control unit is configured to perform a processing for extending timing for conducting the next second control parameter correction processing than scheduled in the case where the first control parameter correction processing is performed based on the determination that the predetermined region is suitable for use for detection in the determination processing.

[Aspect L]

An aspect L has a feature that in the aspect D the control unit is configured to determine that the predetermined region is suitable for use for detection in the determination processing in the case where the line image part (for example the line image) extends in a main-scanning direction perpendicular to a surface moving direction on the surface of the image carrier.

[Aspect M]

An aspect M has a feature that in the aspect L the control unit is configured to use a reflection type photo sensor as the image density detection unit and perform a processing for correcting the control parameter based on a result of acquiring the thickness (for example the line width) of the line image part based on a detection result by the reflection type photo sensor in the parameter correction processing.

Further, the present invention is not limited to these embodiments, but various variations and modifications may be made without departing from the scope of the present invention.

The present application is based on Japanese Priority Applications No. 2013-029942 filed on Feb. 19, 2013 and No. 2014-018634 filed on Feb. 3, 2014, and claims the benefit of priority of Japanese Priority Application No. 2014-018634 filed on Feb. 3, 2014, the entire contents of which are hereby incorporated by reference.

What is claimed is:

1. An image forming apparatus, comprising:

an image information acquisition circuit that acquires image information;

a toner image formation circuit that forms, in response to a control parameter, a toner image on a surface of an image carrier based on the image information acquired by the image information acquisition circuit;

a control circuit that determines, based on the image information, whether to use a predetermined region for a detection of an image density of the toner image in a parameter correction processing, the predetermined region being a segment of the toner image formed on the surface of the image carrier; and an image density detection circuit that, when the control circuit determines to use the predetermined region for the detection of the image density, detects the image density of the toner image formed on the surface of the image carrier and produces a detection result according to the detected image density, wherein the control circuit further performs the parameter correction processing, when the predetermined region is determined to be used for the detection of the image density, to correct the control parameter used by the toner image formation circuit according to the detection result so as to maintain the image density in the predetermined region within a predetermined range.

2. The image forming apparatus as claimed in claim 1, wherein the control circuit determines to use the predetermined region for the detection of the image density when the predetermined region is a solid image part of the toner image, and the control circuit corrects the control parameter so that a predetermined image density for a solid image is obtained in the solid image part in the parameter correction processing.

3. The image forming apparatus as claimed in claim 2, wherein the control circuit determines the predetermined region to be the solid image part when a pixel density in the predetermined region is greater than or equal to a predetermined threshold.

4. The image forming apparatus as claimed in claim 2, wherein the control circuit performs a first control parameter correction processing including the parameter correction processing and a second control parameter correction processing to correct the control parameter so that the predetermined image density is obtained in the predetermined region based on a detection result by the image density detection circuit for image densities of a plurality of toner images, which are included in a pattern image formed on the surface of the image carrier, the image densities of the plurality of toner images being different from each other.

5. The image forming apparatus as claimed in claim 4, wherein the control circuit performs the second control parameter correction processing when the predetermined region is consecutively determined not to be used for the detection of the image density by a predetermined number of times in the determination processing.

6. The image forming apparatus as claimed in claim 4, wherein the control circuit performs the second control parameter correction processing when the predetermined region is consecutively determined to be used for the detection of the image density in the determination processing and the image density in the detection result is outside the predetermined range by a predetermined number of times.

7. The image forming apparatus as claimed in claim 4, wherein the control circuit postpones a timing for performing the next second control parameter correction processing when the predetermined region is determined to be used for the detection of the image density in the determination processing and the image density in the detection result is within the predetermined range.

8. The image forming apparatus as claimed in claim 4, wherein the control circuit postpones a timing for performing the next second control parameter correction processing when the first control parameter correction processing is performed based on the determination to use the predetermined region for the detection of the image density in the determination processing.

9. The image forming apparatus as claimed in claim 1, wherein the control circuit determines to use the predetermined region for the detection of the image density when the predetermined region is a halftone image part of the toner image, and the control circuit corrects the control parameter so that a predetermined image density for a halftone image is obtained in the halftone image part in the parameter correction processing.

10. The image forming apparatus as claimed in claim 9, wherein the control circuit determines to use the predetermined region for the detection of the image density when a dot in the predetermined region is of a predetermined gradation expressed by a dot dispersion type dither matrix.

11. The image forming apparatus as claimed in claim 1, wherein the control circuit determines to use the predetermined region for the detection of the image density when the predetermined region is a line image part of the toner image, and the control circuit corrects the control parameter so that a line image with a predetermined thickness is obtained in the parameter correction processing.

12. The image forming apparatus as claimed in claim 11, wherein the control circuit determines to use the predetermined region for the detection of the image density in the determination processing when the line image part extends in a main-scanning direction which is perpendicular to a surface moving direction on the surface of the image carrier.

13. The image forming apparatus as claimed in claim 12, wherein the image density detection circuit includes a reflection type photo sensor and the control circuit corrects the control parameter based on a thickness of the line image part, which is acquired based on a detection result by the reflection type photo sensor in the parameter correction processing.

14. The image forming apparatus as claimed in claim 1, wherein the control circuit further divides the toner image formed on the surface of the image carrier into a plurality of segmented regions, and the predetermined region is one of the plurality of segmented regions.

15. The image forming apparatus as claimed in claim 1, wherein the image information acquired by the image information acquisition circuit is for a single sheet of a recording medium, the image carrier is the single sheet of recording medium, and the control circuit determines whether to use the predetermined region for the detection of the image density of the toner image in the parameter correction processing based on the image information for the image carrier.

16. The image forming apparatus as claimed in claim 15, wherein the control circuit further divides the toner image formed on the surface of the image carrier into a plurality of segmented regions, and the predetermined region is one of the plurality of segmented regions.

* * * * *